US011158272B2

(12) United States Patent
Kim et al.

(10) Patent No.: US 11,158,272 B2
(45) Date of Patent: Oct. 26, 2021

(54) DISPLAY DEVICE INCLUDING DATA DRIVERS

(71) Applicant: SAMSUNG DISPLAY CO., LTD., Yongin-si (KR)

(72) Inventors: Yeon-Sung Kim, Suwon-si (KR); Bongchun Park, Incheon (KR); Hyunseop Song, Bucheon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/841,981

(22) Filed: Apr. 7, 2020

(65) Prior Publication Data

US 2020/0335055 A1 Oct. 22, 2020

(30) Foreign Application Priority Data

Apr. 17, 2019 (KR) ..... 10-2019-0044956

(51) Int. Cl.
*G09G 3/36* (2006.01)

(52) U.S. Cl.
CPC ..... *G09G 3/3659* (2013.01); *G09G 3/3696* (2013.01); *G09G 2320/0276* (2013.01); *G09G 2320/068* (2013.01); *G09G 2320/0673* (2013.01)

(58) Field of Classification Search
CPC ..... G02F 1/13306; G09G 3/3648; G09G 3/3659; G09G 2310/0205; G09G 2320/0252; G09G 3/3696; G09G 2320/068; G09G 2320/0276; G09G 2320/0673
See application file for complete search history.

(56) References Cited

U.S. PATENT DOCUMENTS 8,581,823 B2 * 11/2013 Min ..... G09G 3/3614 345/96
8,629,950 B2 * 1/2014 Kim ..... G09G 3/3648 349/48
8,754,882 B2 * 6/2014 Maekawa ..... G09G 3/006 345/211
9,530,368 B2 * 12/2016 Lee ..... G09G 3/3614
9,633,619 B2 * 4/2017 Xu ..... G09G 3/2003
10,247,994 B2 * 4/2019 Zhang ..... G02F 1/136286
(Continued)

FOREIGN PATENT DOCUMENTS

KR 1020130105777 A 9/2013
KR 1020180046033 A 5/2018
KR 1020190006133 A 1/2019

*Primary Examiner* — Michael J Jansen, II
(74) *Attorney, Agent, or Firm* — Cantor Colburn LLP

(57) ABSTRACT

A display device includes a display panel including pixels disposed at rows and columns, first data lines respectively disposed at the columns, and second data lines respectively disposed at the columns, a first data driver connected to the first data lines, and a second data driver connected to the second data lines. A first portion of the pixels are connected to the first data lines, and a second portion of the pixels are connected to the second data lines. The first data driver provides first gray voltages corresponding to a first gamma curve to the first portion of the pixels through the first data lines, and the second data driver provides second gray voltages corresponding to a second gamma curve different from the first gamma curve to the second portion of the pixels through the second data lines.

19 Claims, 22 Drawing Sheets

(56) References Cited

U.S. PATENT DOCUMENTS

| | | | | |
|---|---|---|---|---|
| 10,365,521 | B2 * | 7/2019 | Gan | G02F 1/136286 |
| 10,424,265 | B2 * | 9/2019 | Kim | G09G 3/3696 |
| 2007/0195041 | A1 * | 8/2007 | Lee | G09G 3/2074 345/89 |
| 2008/0303771 | A1 * | 12/2008 | Chen | G09G 3/3688 345/94 |
| 2009/0033590 | A1 * | 2/2009 | Feng | G09G 3/3614 345/58 |
| 2009/0174642 | A1 * | 7/2009 | Min | G09G 3/3614 345/92 |
| 2009/0284673 | A1 * | 11/2009 | Kim | G02F 1/133707 349/33 |
| 2010/0315402 | A1 * | 12/2010 | Hashimoto | G09G 3/3648 345/211 |
| 2013/0016083 | A1 * | 1/2013 | Maekawa | G09G 3/006 345/211 |
| 2013/0241905 | A1 * | 9/2013 | Kim | G09G 3/3648 345/204 |
| 2015/0145758 | A1 * | 5/2015 | Lee | G09G 3/3648 345/87 |
| 2016/0118000 | A1 * | 4/2016 | Kim | G09G 3/3688 345/691 |
| 2017/0039966 | A1 * | 2/2017 | Xu | G09G 3/3648 |
| 2018/0031935 | A1 * | 2/2018 | Gan | G02F 1/13454 |
| 2018/0373105 | A1 * | 12/2018 | Zhang | H01L 27/124 |
| 2020/0258443 | A1 * | 8/2020 | Xu | G09G 3/3607 |

* cited by examiner

@GOT1

@GOT3

@GOT1 & GOT2

@GOT2 & GOT3

@GOT3 & GOT4

DISPLAY DEVICE INCLUDING DATA DRIVERS

This application claims priority to Korean Patent Application No. 10-2019-0044956, filed on Apr. 17, 2019, and all the benefits accruing therefrom under 35 U.S.C. § 119, the content of which in its entirety is herein incorporated by reference.

BACKGROUND

1. Field

Exemplary embodiments of the invention relate to a display device, and more particularly to a display device including a plurality of data drivers providing gray voltages corresponding to different gamma curves.

2. Description of the Related Art

In general, a display device, such as a liquid crystal display ("LCD") device, includes a first substrate including a pixel electrode, a second substrate including a common electrode and a liquid crystal layer disposed between the first and second substrates. An electric field is generated by voltages respectively applied to the pixel electrode and the common electrode. By adjusting an intensity of the electric field, a transmittance of light passing through the liquid crystal layer may be adjusted so that a desired image may be displayed.

Although the LCD device may be substantially thin, the LCD device may have a narrow viewing angle. To improve the viewing angle, an LCD panel where each pixel includes two sub-pixels having different gamma characteristics, or a high sub-pixel having a high gamma characteristic and a low sub-pixel having a low gamma characteristic has been developed. However, the display panel where each pixel includes the high sub-pixel and the low sub-pixel may have a low aperture ratio.

SUMMARY

To prevent an aperture ratio deterioration caused by high and low sub-pixels, a technique where respective pixels have a high gamma characteristic and a low gamma characteristic by modulating image data has been developed. However, this technique requires complicated data processing and/or additional storage space.

Some exemplary embodiments provide a display device capable of improving a side visibility of the display device without deterioration of an aperture ratio.

An exemplary embodiment provides a display device including a display panel including a plurality of pixels disposed at a plurality of rows and a plurality of columns, a plurality of first data lines respectively disposed at the plurality of columns, and a plurality of second data lines respectively disposed at the plurality of columns, a first data driver connected to the plurality of first data lines, and a second data driver connected to the plurality of second data lines. A first portion of the plurality of pixels is connected to the plurality of first data lines, and a second portion of the plurality of pixels is connected to the plurality of second data lines. The first data driver provides first gray voltages corresponding to a first gamma curve to the first portion of the plurality of pixels through the plurality of first data lines, and the second data driver provides second gray voltages corresponding to a second gamma curve different from the first gamma curve to the second portion of the plurality of pixels through the plurality of second data lines.

In an exemplary embodiment, the first gamma curve may be a high gamma curve having a high gamma value greater than a reference gamma value, and the second gamma curve may be a low gamma curve having a low gamma value less than the reference gamma value.

In an exemplary embodiment, the display device may further include a gamma reference voltage generator which generates a first gamma reference voltage corresponding to the first gamma curve and a second gamma reference voltage corresponding to the second gamma curve, provides the first gamma reference voltage to the first data driver, and provides the second gamma reference voltage to the second data driver. The first data driver may generate the first gray voltages corresponding to the first gamma curve based on the first gamma reference voltage, and the second data driver may generate the second gray voltages corresponding to the second gamma curve based on the second gamma reference voltage.

In an exemplary embodiment, the display device may further include a power management circuit which generates a first analog reference voltage, and a second analog reference voltage different from the first analog reference voltage. The gamma reference voltage generator may generate the first gamma reference voltage by dividing the first analog reference voltage, and may generate the second gamma reference voltage by dividing the second analog reference voltage.

In exemplary embodiments, the first data driver may receive the first analog reference voltage and the first gamma reference voltage, and may generate the first gray voltages corresponding to the first gamma curve by dividing the first analog reference voltage and the first gamma reference voltage. The second data driver may receive the second analog reference voltage and the second gamma reference voltage, and may generate the second gray voltages corresponding to the second gamma curve by dividing the second analog reference voltage and the second gamma reference voltage.

In an exemplary embodiment, the first data driver may be disposed on a first film connected to the plurality of first data lines of the display panel. The second data driver may be disposed on a second film above the first film, and the second film may be connected to the plurality of second data lines of the display panel.

In an exemplary embodiment, the display panel may further include a plurality of gate lines, and a number of the plurality of gate lines may be half of a number of the plurality of rows. The plurality of pixels at two rows of the plurality of rows may be connected to one of the plurality of gate lines.

In an exemplary embodiment, the plurality of pixels may include a first pixel disposed at a first row of the plurality of rows and a first column of the plurality of columns, connected to one of the plurality of first data lines disposed at the first column, and connected to a first gate line of the plurality of gate lines, a second pixel disposed at a second row of the plurality of rows and the first column, connected to one of the plurality of second data lines disposed at the first column, and connected to the first gate line, a third pixel disposed at a third row of the plurality of rows and the first column, connected to the one of the plurality of first data lines disposed at the first column, and connected to a second gate line of the plurality of gate lines, and a fourth pixel disposed at a fourth row of the plurality of rows and the first column, connected to the one of the plurality of second data lines disposed at the first column, and connected to the second gate line. The first pixel and the third pixel may display an image with luminance corresponding to the first gamma curve, and the second pixel and the fourth pixel may display the image with luminance corresponding to the second gamma curve.

In an exemplary embodiment, the plurality of pixels may include a first pixel disposed at a first row of the plurality of rows and a first column of the plurality of columns, connected to one of the plurality of first data lines disposed at the first column, and connected to a first gate line of the plurality of gate lines, a second pixel disposed at a second row of the plurality of rows and the first column, connected to one of the plurality of second data lines disposed at the first column, and connected to the first gate line, a third pixel disposed at a third row of the plurality of rows and the first column, connected to the one of the plurality of second data lines disposed at the first column, and connected to a second gate line of the plurality of gate lines, and a fourth pixel disposed at a fourth row of the plurality of rows and the first column, connected to the one of the plurality of first data lines disposed at the first column, and connected to the second gate line. The first pixel and the fourth pixel may display an image with luminance corresponding to the first gamma curve, and the second pixel and the third pixel may display the image with luminance corresponding to the second gamma curve.

In an exemplary embodiment, the display panel may further include a plurality of gate lines respectively disposed at the plurality of rows. The plurality of pixels at each of the plurality of rows may be connected to one of the plurality of gate lines.

In an exemplary embodiment, the plurality of pixels may include a first pixel disposed at a first row of the plurality of rows and a first column of the plurality of columns, connected to one of the plurality of first data lines disposed at the first column, and connected to a first gate line of the plurality of gate lines, a second pixel disposed at a second row of the plurality of rows and the first column, connected to one of the plurality of second data lines disposed at the first column, and connected to a second gate line of the plurality of gate lines, a third pixel disposed at a third row of the plurality of rows and the first column, connected to the one of the plurality of first data lines disposed at the first column, and connected to a third gate line of the plurality of gate lines, and a fourth pixel disposed at a fourth row of the plurality of rows and the first column, connected to the one of the plurality of second data lines disposed at the first column, and connected to a fourth gate line of the plurality of gate lines. The first pixel and the third pixel may display an image with luminance corresponding to the first gamma curve, and the second pixel and the fourth pixel may display the image with luminance corresponding to the second gamma curve.

In an exemplary embodiment, the plurality of pixels may include a first pixel disposed at a first row of the plurality of rows and a first column of the plurality of columns, connected to one of the plurality of first data lines disposed at the first column, and connected to a first gate line of the plurality of gate lines, a second pixel disposed at a second row of the plurality of rows and the first column, connected to one of the plurality of second data lines disposed at the first column, and connected to a second gate line of the plurality of gate lines, a third pixel disposed at a third row of the plurality of rows and the first column, connected to the one of the plurality of second data lines disposed at the first column, and connected to a third gate line of the plurality of gate lines, and a fourth pixel disposed at a fourth row of the plurality of rows and the first column, connected to the one of the plurality of first data lines disposed at the first column, and connected to a fourth gate line of the plurality of gate lines. The first pixel and the fourth pixel may display an image with luminance corresponding to the first gamma curve, and the second pixel and the third pixel may display the image with luminance corresponding to the second gamma curve.

In an exemplary embodiment, the plurality of pixels disposed at a first column and a fourth column of the plurality of columns may be red pixels, the plurality of pixels disposed at a second column adjacent to the first column and a fifth column adjacent to the fourth column of the plurality of columns may be green pixels, and the plurality of pixels disposed at a third column adjacent to the second column and a sixth column adjacent to the fifth column of the plurality of columns may be blue pixels.

In an exemplary embodiment, the red, green and blue pixels disposed at a first row of the plurality of rows and respectively disposed at the first, second and third columns may be connected to the plurality of first data lines, and the red, green and blue pixels disposed at the first row and respectively disposed at the fourth, fifth and sixth columns may be connected to the plurality of second data lines.

In an exemplary embodiment, the red, green and blue pixels disposed at the first row and respectively disposed at the first, second and third columns may display an image with luminance corresponding to the first gamma curve, and the red, green and blue pixels disposed at the first row and respectively disposed at the fourth, fifth and sixth columns may display the image with luminance corresponding to the second gamma curve.

An exemplary embodiment provides a display device including a display panel including a plurality of pixels disposed at a plurality of rows and a plurality of columns, a plurality of first data lines respectively disposed at the plurality of columns, a plurality of second data lines respectively disposed at the plurality of columns, and a plurality of gate lines, a number of the plurality of gate lines being half of a number of the plurality of rows, a first data driver connected to the plurality of first data lines, a second data driver connected to the plurality of second data lines, and a gate driver connected to the plurality of gate lines. The plurality of pixels include a first pixel disposed at a first row of the plurality of rows and a first column of the plurality of columns, connected to one of the plurality of first data lines disposed at the first column, and connected to a first gate line of the plurality of gate lines, and a second pixel disposed at a second row of the plurality of rows and the first column, connected to one of the plurality of second data lines disposed at the first column, and connected to the first gate line. While the gate driver applies a gate signal to the first gate line, the first data driver provides a first gray voltage corresponding to a first gamma curve to the first pixel through the one of the plurality of first data lines disposed at the first column, and the second data driver provides a second gray voltage corresponding to a second gamma curve different from the first gamma curve to the second pixel through the one of the plurality of second data lines disposed at the first column.

In an exemplary embodiment, the first gamma curve may be a high gamma curve having a high gamma value greater than a reference gamma value, and the second gamma curve may be a low gamma curve having a low gamma value less than the reference gamma value.

In an exemplary embodiment, the plurality of pixels may further include a third pixel disposed at a third row of the plurality of rows and the first column, connected to the one of the plurality of first data lines disposed at the first column, and connected to a second gate line of the plurality of gate lines, and a fourth pixel disposed at a fourth row of the plurality of rows and the first column, connected to the one of the plurality of second data lines disposed at the first column, and connected to the second gate line. The first pixel and the third pixel may display an image with luminance corresponding to the first gamma curve, and the second pixel and the fourth pixel may display the image with luminance corresponding to the second gamma curve.

In an exemplary embodiment, the plurality of pixels may further include a third pixel disposed at a third row of the plurality of rows and the first column, connected to the one of the plurality of second data lines disposed at the first column, and connected to a second gate line of the plurality of gate lines, and a fourth pixel disposed at a fourth row of the plurality of rows and the first column, connected to the one of the plurality of first data lines disposed at the first column, and connected to the second gate line. The first pixel and the fourth pixel may display an image with luminance corresponding to the first gamma curve, and the second pixel and the third pixel may display the image with luminance corresponding to the second gamma curve.

An exemplary embodiment provides a display device including a display panel including a plurality of pixels disposed at a plurality of rows and a plurality of columns, a plurality of first data lines respectively disposed at the plurality of columns, a plurality of second data lines respectively disposed at the plurality of columns, and a plurality of gate lines respectively disposed at the plurality of rows, a first data driver connected to the plurality of first data lines, a second data driver connected to the plurality of second data lines, and a gate driver connected to the plurality of gate lines. The plurality of pixels include a first pixel disposed at a first row of the plurality of rows and a first column of the plurality of columns, connected to one of the plurality of first data lines disposed at the first column, and connected to a first gate line of the plurality of gate lines, and a second pixel disposed at a second row of the plurality of rows and the first column, connected to one of the plurality of second data lines disposed at the first column, and connected to a second gate line of the plurality of gate lines. While the gate driver applies a gate signal to the first gate line, the first data driver provides a first gray voltage corresponding to a first gamma curve to the first pixel through the one of the plurality of first data lines disposed at the first column. While the gate driver applies the gate signal to the second gate line, the second data driver provides a second gray voltage corresponding to a second gamma curve different from the first gamma curve to the second pixel through the one of the plurality of second data lines disposed at the first column.

As described above, in the exemplary embodiments of a display device, a display panel may include a plurality of first data lines respectively disposed at a plurality of pixel columns and a plurality of second data lines respectively disposed at the plurality of pixel columns, a first data driver may provide first gray voltages corresponding to a first gamma curve to a first portion of pixels through the plurality of first data lines, and a second data driver may provide second gray voltages corresponding to a second gamma curve to a second portion of pixels through the plurality of second data lines. Accordingly, even when image data are modulated, a side visibility of the display device in exemplary embodiments may be improved without deterioration of an aperture ratio.

BRIEF DESCRIPTION OF THE DRAWINGS

Illustrative, non-limiting exemplary embodiments will be more clearly understood from the following detailed description in conjunction with the accompanying drawings.

DETAILED DESCRIPTION

Figure 1:
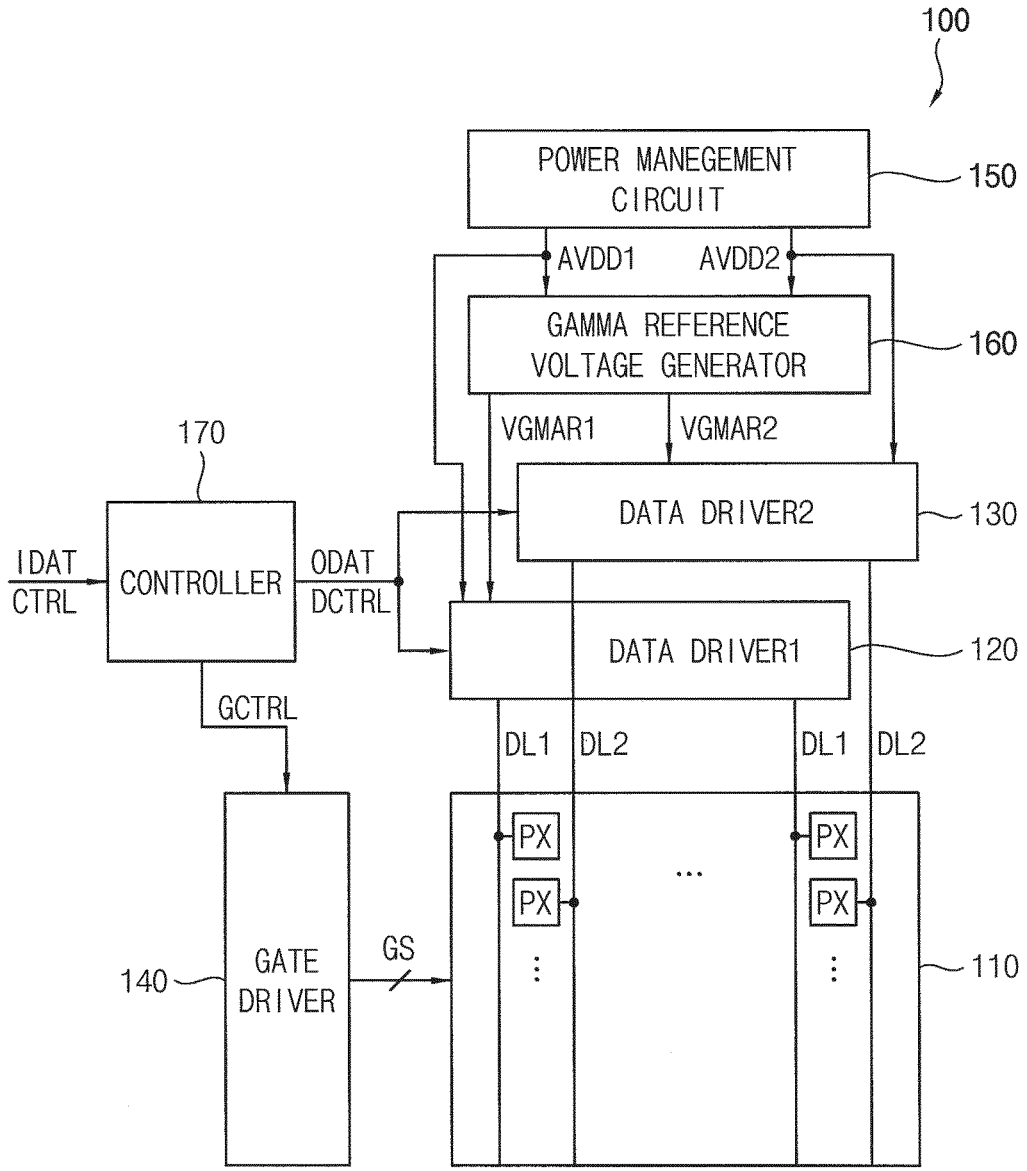
FIG. 1 is a block diagram illustrating an exemplary embodiment of a display device.

The invention now will be described more fully hereinafter with reference to the accompanying drawings, in which various exemplary embodiments are shown. This invention may, however, be embodied in many different forms, and should not be construed as limited to the exemplary embodiments set forth herein. Rather, these exemplary embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular exemplary embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, exemplary embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be explained in detail with reference to the accompanying drawings.

Figure 2:
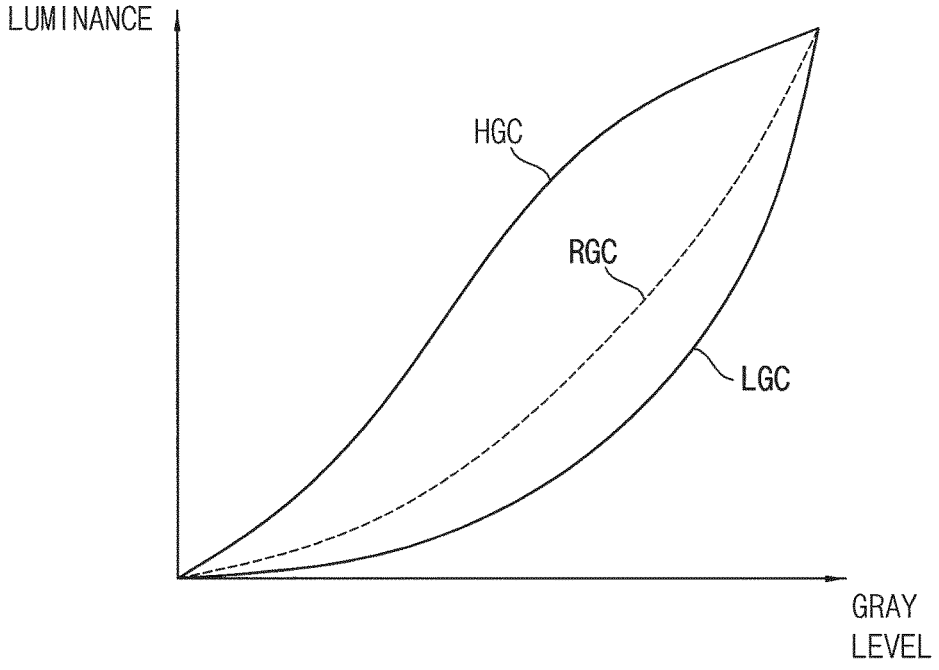
FIG. 2 is a diagram illustrating an exemplary embodiment of a first gamma curve implemented by a first data driver and a second gamma curve implemented by a second data driver.
Figure 3:
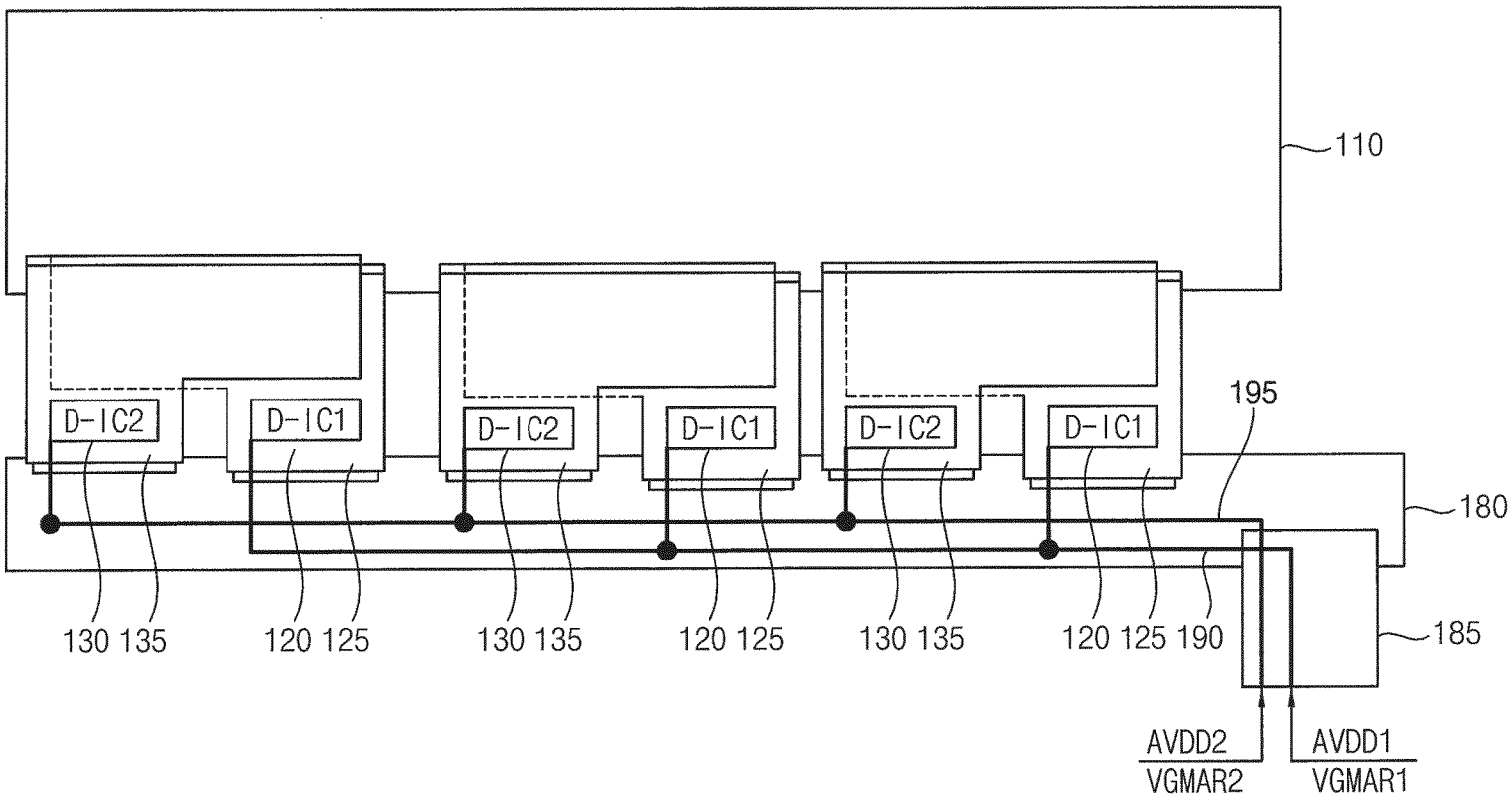
FIG. 3 is a diagram illustrating an exemplary embodiment of an exemplary embodiment of a display device.

FIG. 1 is a block diagram illustrating an exemplary embodiment of a display device, FIG. 2 is a diagram illustrating an exemplary embodiment of a first gamma curve implemented by a first data driver and a second gamma curve implemented by a second data driver, and FIG. 3 is a diagram illustrating an exemplary embodiment of a display device.

Referring to FIG. 1, an exemplary embodiment of a display device 100 may include a display panel 110 including a plurality of first data lines DL1 and a plurality of second data lines DL2, a first data driver 120 connected to the plurality of first data lines DL1, and a second data driver 130 connected to the plurality of second data lines DL2. In some exemplary embodiments, the display device 100 may further include a gate driver 140, a power management circuit 150, a gamma reference voltage generator 160 and a controller 170.

The display panel 110 may include a plurality of pixels PX disposed at a plurality of rows and a plurality of columns, the plurality of first data lines DL1 respectively disposed at the plurality of columns, and the plurality of second data lines DL2 respectively disposed at the plurality of columns. Thus, in the display panel 110, two data lines DL1 and DL2 may be disposed at each column or each pixel column. A first portion of the plurality of pixels PX may be connected to the plurality of first data lines DL1, and a second portion (or the remaining portion) of the plurality of pixels PX may be connected to the plurality of second data lines DL2. In some exemplary embodiments, the pixels PX at each column may be connected alternately per pixel PX to the first data line DL1 or to the second data line DL2. In other exemplary embodiments, the pixels PX at each column may be connected alternately per two pixels PX to the first data line DL1 or to the second data line DL2. Unlike a conventional display panel where each pixel includes a high sub-pixel and a low sub-pixel to implement a wide viewing angle, the respective pixels PX of the display panel 110 in an exemplary embodiment may receive data voltages (or gray voltages) corresponding to different pixel image data, and each pixel PX of the display panel 110 may not be divided into the high and low sub-pixels, but may be a single unit pixel. Further, in some exemplary embodiments, the plurality of pixels PX may have substantially the same structure and may have substantially the same size. In some exemplary embodiments, each pixel PX may include a switching transistor and a liquid crystal capacitor coupled to the switching transistor, and the display panel 110 may be a liquid crystal display ("LCD") panel. In an exemplary embodiment, the display panel 110 may be a vertical alignment ("VA") mode LCD panel, for example. However, the display panel 110 may not be limited to the LCD panel, and may be any suitable display panel.

In some exemplary embodiments, the display panel 110 may further include a plurality of gate lines, and the number of the plurality of gate lines may be half of the number of the plurality of rows. That is, the display panel 110 may have a half gate double data ("HG2D") structure where one gate line is provided per two rows and two data lines are provided per one column. In this case, compared with a display panel where one gate line is provided per one row, a time during which a gate signal is applied to each gate line may be increased. Thus, the display panel 110 having the HG2D structure may be suitable for a large-sized display device that may have an insufficient gate signal application time (or an insufficient gate on time). In other exemplary embodiments, the display panel 110 may further include a plurality of gate lines respectively disposed at the plurality of rows. That is, the display panel 110 may have a one gate double data ("1G2D") structure where one gate line is provided per one row and two data lines are provided per one column.

The first and second data drivers 120 and 130 generate data signals based on output image data ODAT and a data control signal DCTRL output from the controller 170, and may provide the data signals to the plurality of pixels PX. In an exemplary embodiment, the data control signal DCTRL may include, but not be limited to, an output data enable signal, a horizontal start signal and a load signal, for example.

The first data driver 120 may be connected to the plurality of first data lines DL1, and may provide first gray voltages corresponding to a first gamma curve to the first portion of the plurality of pixels PX through the plurality of first data lines DL1. The second data driver 130 may be connected to the plurality of second data lines DL2, and may provide second gray voltages corresponding to a second gamma curve different from the first gamma curve to the second portion of the plurality of pixels PX through the plurality of second data lines DL2. In some exemplary embodiments, the first gamma curve implemented by the first data driver 120 may be a high gamma curve HGC having a high gamma value greater than a reference gamma value of a reference gamma curve RGC (or a normal gamma curve), and the second gamma curve implemented by the second data driver 130 may be a low gamma curve LGC having a low gamma value less than the reference gamma value of the reference gamma curve RGC. In an exemplary embodiment, the reference gamma value of the reference gamma curve RGC may be, but not limited to, about 2.2, for example.

As described above, in an exemplary embodiment of the display device 100, the first data driver 120 may provide the first gate voltages corresponding to the high gamma curve HGC to the first portion of the plurality of pixels PX, and the second data driver 130 may provide the second gate voltages corresponding to the low gamma curve LGC to the second portion of the plurality of pixels PX. Accordingly, although data modulation on the output image data ODAT provided to the first and second data drivers 120 and 130 is not performed, the first portion of the plurality of pixels PX may display an image with luminance corresponding to the high gamma curve HGC, and the second portion of the plurality of pixels PX may display an image with luminance corresponding to the low gamma curve LGC. Accordingly, the display device 100 in exemplary embodiments may improve a side visibility without deterioration of an aperture ratio.

In some exemplary embodiments, a gamma characteristic of the first data driver 120 (or a gamma curve corresponding to gray voltages outputted from the first data driver 120) and a gamma characteristic of the second data driver 130 (or a gamma curve corresponding to gray voltages outputted from the second data driver 130) may be switched with a constant period (e.g., a constant period corresponding to one or more frames) or with a random period. In an exemplary embodiment, the gamma characteristic of the first data driver 120 and the gamma characteristic of the second data driver 130 may be switched per frame, for example. In this case, in odd-numbered frames, the first data driver 120 may output the first gray voltages corresponding to the first gamma curve (e.g., the high gamma curve HGC), and the second data driver 130 may output the second gray voltages corresponding to the second gamma curve (e.g., the low gamma curve LGC). In even-numbered frames, the first data driver 120 may output the second gray voltages corresponding to the second gamma curve (e.g., the low gamma curve LGC), and the second data driver 130 may output the first gray voltages corresponding to the first gamma curve (e.g., the high gamma curve HGC). Thus, in the odd-numbered frames, the first portion of the plurality of pixels PX connected to the plurality of first data lines DL1 may display an image with luminance corresponding to the high gamma curve HGC, and the second portion of the plurality of pixels PX connected to the plurality of second data lines DL2 may display an image with luminance corresponding to the low gamma curve LGC. In the even-numbered frames, the first portion of the plurality of pixels PX may display the image with luminance corresponding to the low gamma curve LGC, and the second portion of the plurality of pixels PX may display the image with luminance corresponding to the high gamma curve HGC. Accordingly, the image quality of the display panel 110 in exemplary embodiments may be further improved.

In some exemplary embodiments, the display device 100 may further include a source board (e.g., a source printed circuit board ("PCB") or a source printed board assembly ("PBA")) 180, first and second films 125 and 135 connecting the source board 180 and the display panel 110, a control board (e.g., a control PCB or a control PBA), and a third film 185 connecting the source board 180 and the control board. In an exemplary embodiment, each of the first and second films 125 and 135 may be, but not limited to, a flexible film, for example. Further, for example, the third film 185 may be, but not limited to, a flexible flat cable ("FFC") or a flexible printed circuit ("FPC"). The first film 125 may be connected to the plurality of first data lines DL1 of the display panel 110, and the second film 135 may be connected to the plurality of second data lines DL2 of the display panel 110. Further, in some exemplary embodiments, the first data driver 120 may be disposed on the first film 125 in a chip on film ("COF") manner or a tape automated bonding ("TAB")

manner, the second film 135 may be disposed above the first film 125, and the second data driver 130 may be disposed on the second film 135 in the COF manner or the TAB manner. In some exemplary embodiments, as illustrated in FIG. 3, each of the first and second data drivers 120 and 130 implemented with a plurality of data driver integrated circuits ("ICs"). In other exemplary embodiments, each of the first and second data drivers 120 and 130 implemented with one data drive IC.

The gate driver 140 may generate gate signals GS based on a gate control signal GCTRL from the controller 170, and may provide the gate signals GS to the plurality of pixels PX on a row-by-row basis. In an exemplary embodiment, the gate control signal GCTRL may include, but not be limited to, a gate start pulse and a gate clock signal, for example. In some exemplary embodiments, the gate driver 140 may be implemented as an amorphous silicon gate ("ASG") driver integrated in a peripheral portion of the display panel 110. In other exemplary embodiments, the gate driver 140 may be implemented with one or more gate driver ICs. Further, according to some exemplary embodiments, the gate driver 140 may be disposed (e.g., mounted) directly on the display panel 110 in a chip on glass ("COG") manner, or may be coupled to the display panel 110 in the COF manner or the TAB manner.

The gamma reference voltage generator 160 may generate a first gamma reference voltage VGMAR1 corresponding to the first gamma curve (e.g., the high gamma curve HGC of FIG. 2) and a second gamma reference voltage VGMAR2 corresponding to the second gamma curve (e.g., the low gamma curve LGC of FIG. 2). In some exemplary embodiments, the gamma reference voltage generator 160 may receive first and second analog reference voltages AVDD1 and AVDD2 that are different from each other from the power management circuit 150, may generate the first gamma reference voltage VGMAR1 (e.g., 18 first gamma reference voltages) by dividing the first analog reference voltage AVDD1 (into the 18 first gamma reference voltages), and may generate the second gamma reference voltage VGMAR2 (e.g., 18 second gamma reference voltages) by dividing the second analog reference voltage AVDD2 (into the 18 second gamma reference voltages).

In some exemplary embodiments, the first data driver 120 may receive the first gamma reference voltage VGMAR1 from the gamma reference voltage generator 160, may generate the first gray voltages (e.g., 256 first gray voltages) corresponding to the first gamma curve (e.g., the high gamma curve HGC of FIG. 2) by dividing the first gamma reference voltage VGMAR1 (into the 256 first gray voltages), may select the first gray voltages according to gray levels represented by the output image data ODAT, and may provide the selected first gray voltages as the data signals to the first portion of the plurality of pixels PX. Further, the second data driver 130 may receive the second gamma reference voltage VGMAR2 from the gamma reference voltage generator 160, may generate the second gray voltages (e.g., 256 second gray voltages) corresponding to the second gamma curve (e.g., the low gamma curve LGC of FIG. 2) by dividing the second gamma reference voltage VGMAR2 (into the 256 second gray voltages), may select the second gray voltages according to gray levels represented by the output image data ODAT, and may provide the selected second gray voltages as the data signals to the second portion of the plurality of pixels PX. Accordingly, although the data modulation on the output image data ODAT is not performed, the first portion of the plurality of pixels PX may display an image with luminance corresponding to the high gamma curve HGC, and the second portion of the plurality of pixels PX may display an image with luminance corresponding to the low gamma curve LGC.

In some exemplary embodiments, the first gamma reference voltage VGMAR1 provided to the first data driver 120 and the second gamma reference voltage VGMAR2 provided to the second data driver 130 may be switched with a constant period (e.g., a constant period corresponding to one or more frames) or with a random period. In an exemplary embodiment, in odd-numbered frames, the gamma reference voltage generator 160 may provide the first gamma reference voltage VGMAR1 corresponding to the first gamma curve (e.g., the high gamma curve HGC) to the first data driver 120, and may provide the second gamma reference voltage VGMAR2 corresponding to the second gamma curve (e.g., the low gamma curve LGC) to the second data driver 130, for example. In even-numbered frames, the gamma reference voltage generator 160 may provide the second gamma reference voltage VGMAR2 corresponding to the second gamma curve (e.g., the low gamma curve LGC) to the first data driver 120, and may provide the first gamma reference voltage VGMAR1 corresponding to the first gamma curve (e.g., the high gamma curve HGC) to the second data driver 130. In this case, in the odd-numbered frames, the first portion of the plurality of pixels PX may display an image with luminance corresponding to the high gamma curve HGC, and the second portion of the plurality of pixels PX may display an image with luminance corresponding to the low gamma curve LGC. Further, in the even-numbered frames, the first portion of the plurality of pixels PX may display the image with luminance corresponding to the low gamma curve LGC, and the second portion of the plurality of pixels PX may display the image with luminance corresponding to the high gamma curve HGC. Accordingly, the image quality of the display panel 110 in exemplary embodiments may be further improved.

The power management circuit 150 may generate the first analog reference voltage AVDD1, and the second analog reference voltage AVDD2 different from the first analog reference voltage AVDD1. In some exemplary embodiments, the power management circuit 150 may be implemented with a direct current to direct current ("DC-DC") converter that converts an input voltage supplied from an external host into the first and second analog reference voltages AVDD1 and AVDD2. Further, in some exemplary embodiments, the power management circuit 150 may further generate a common voltage, a gate driving voltage, etc. The power management circuit 150 may provide the first analog reference voltage AVDD1 and the second analog reference voltage AVDD2 to the gamma reference voltage generator 160, and the gamma reference voltage generator 160 may generate the first gamma reference voltage VGMAR1 by dividing the first analog reference voltage AVDD1, and may generate the second gamma reference voltage VGMAR2 by dividing the second analog reference voltage AVDD2.

In some exemplary embodiments, as illustrated in FIG. 3, the first data driver 120 may receive the first analog reference voltage AVDD1 and the first gamma reference voltage VGMAR1 through the third film 185, the source board 180 and wirings 190 disposed on the first film 125, and the second data driver 130 may receive the second analog reference voltage AVDD2 and the second gamma reference voltage VGMAR2 through the third film 185, the source board 180 and wirings 195 disposed on the second film 135. The first data driver 120 may generate the first gray voltages corresponding to the first gamma curve (e.g., the high gamma curve HGC of FIG. 2) by dividing the first analog reference voltage AVDD1 and the first gamma reference voltage VGMAR1, may select the first gray voltages according to gray levels represented by the output image data ODAT, and may provide the selected first gray voltages as the data signals to the first portion of the plurality of pixels PX. Further, the second data driver 130 may generate the second gray voltages corresponding to the second gamma curve (e.g., the low gamma curve LGC of FIG. 2) by dividing the second analog reference voltage AVDD2 and the second gamma reference voltage VGMAR2, may select the second gray voltages according to gray levels represented by the output image data ODAT, and may provide the selected second gray voltages as the data signals to the second portion of the plurality of pixels PX. Accordingly, although the data modulation on the output image data ODAT is not performed, the first portion of the plurality of pixels PX may display an image with luminance corresponding to the high gamma curve HGC, and the second portion of the plurality of pixels PX may display an image with luminance corresponding to the low gamma curve LGC.

In some exemplary embodiments, the first analog reference voltage AVDD1 and the first gamma reference voltage VGMAR1 provided to the first data driver 120 and the second analog reference voltage AVDD2 and the second gamma reference voltage VGMAR2 provided to the second data driver 130 may be switched with a constant period (e.g., a constant period corresponding to one or more frames) or with a random period. In an exemplary embodiment, in odd-numbered frames, the first data driver 120 may receive the first analog reference voltage AVDD1 and the first gamma reference voltage VGMAR1 corresponding to the first gamma curve (e.g., the high gamma curve HGC), and the second data driver 130 may receive the second analog reference voltage AVDD2 and the second gamma reference voltage VGMAR2 corresponding to the second gamma curve (e.g., the low gamma curve LGC), for example. In even-numbered frames, the first data driver 120 may receive the second analog reference voltage AVDD2 and the second gamma reference voltage VGMAR2 corresponding to the second gamma curve (e.g., the low gamma curve LGC), and the second data driver 130 may receive the first analog reference voltage AVDD1 and the first gamma reference voltage VGMAR1 corresponding to the first gamma curve (e.g., the high gamma curve HGC). In this case, in the odd-numbered frames, the first portion of the plurality of pixels PX may display an image with luminance corresponding to the high gamma curve HGC, and the second portion of the plurality of pixels PX may display an image with luminance corresponding to the low gamma curve LGC. Further, in the even-numbered frames, the first portion of the plurality of pixels PX may display the image with luminance corresponding to the low gamma curve LGC, and the second portion of the plurality of pixels PX may display the image with luminance corresponding to the high gamma curve HGC. Accordingly, the image quality of the display panel 110 in exemplary embodiments may be further improved.

The controller 170 may receive input image data IDAT and a control signal CTRL from an external host processor (e.g., a graphic processing unit ("GPU") or a graphic card). In an exemplary embodiment, the input image data IDAT may be, but not limited to, RGB data including red image data, green image data and blue image data, for example. Further, for example, the control signal CTRL may include, but not be limited to, a vertical synchronization signal, a horizontal synchronization signal, an input data enable signal, a master clock signal, etc. The controller 170 may generate the output image data ODAT, the data control signal DCTRL and the gate control signal GCTRL based on the input image data IDAT and the control signal CTRL. The controller 170 may control operations of the first and second data drivers 120 and 130 by providing the output image data ODAT and the data control signal DCTRL to the first and second data drivers 120 and 130, and may control an operation of the gate driver 140 by providing the gate control signal GCTRL to the gate driver 140. In some exemplary embodiments, the controller 170 may be a timing controller ("TCON"), for example.

As described above, in the display device 100 in exemplary embodiments, the display panel 110 may include the plurality of first data lines DL1 respectively disposed at the plurality of columns and the plurality of second data lines DL2 respectively disposed at the plurality of columns, the first data driver 120 may provide the first gray voltages corresponding to the first gamma curve (e.g., the high gamma curve HGC of FIG. 2) to the first portion of the plurality of pixels PX through the plurality of first data lines DL1 based on the first gamma reference voltage VGMAR1 and/or the first analog reference voltage AVDD1, and the second data driver 130 may provide the second gray voltages corresponding to the second gamma curve (e.g., the low gamma curve LGC of FIG. 2) to the second portion of the plurality of pixels PX through the plurality of second data lines DL2 based on the second gamma reference voltage VGMAR2 and/or the second analog reference voltage AVDD2. Accordingly, without the modulation of the image data, the display device 100 in exemplary embodiments may improve a side visibility while an aperture ratio is not deteriorated.

Figure 4:
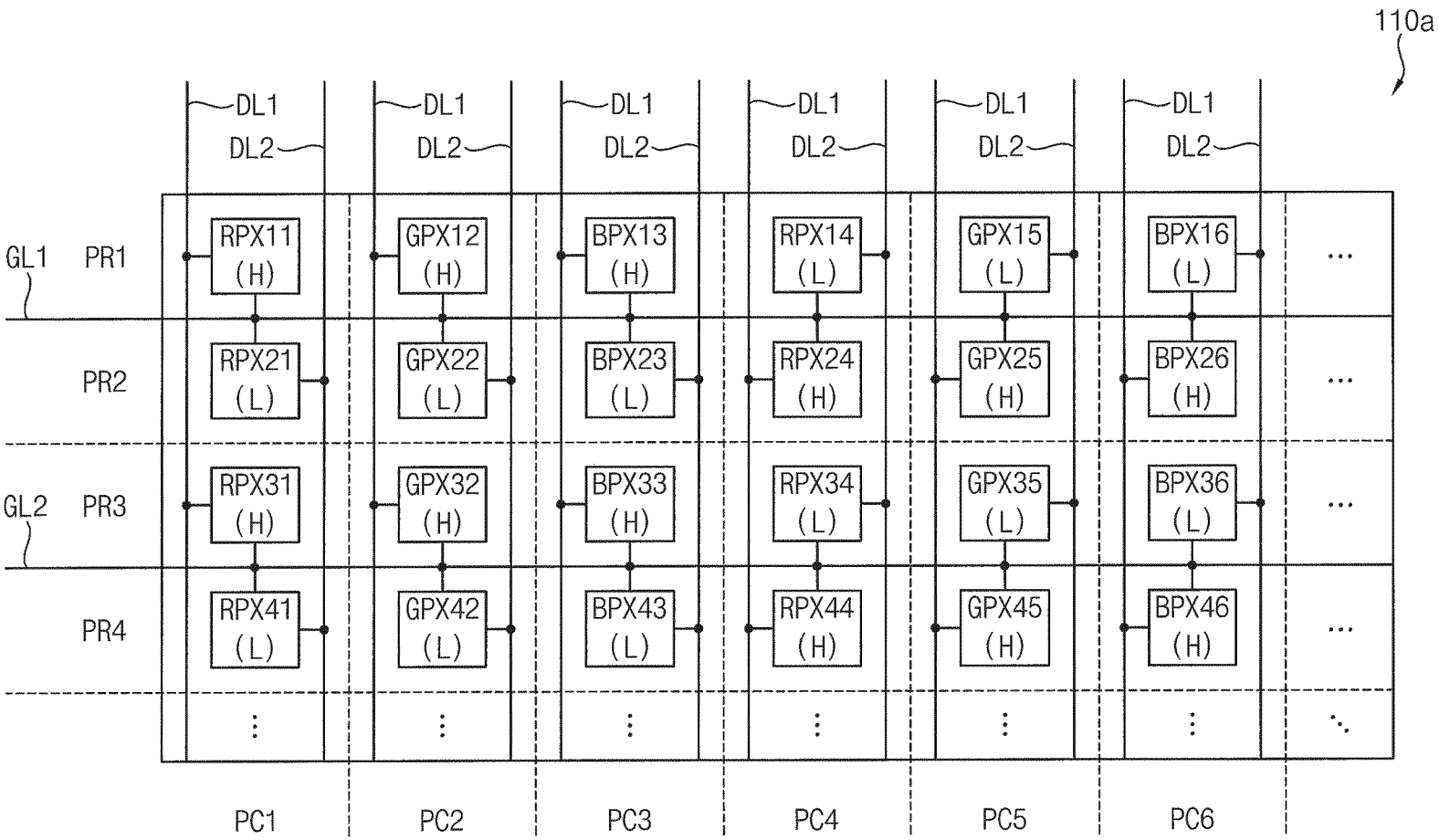
FIG. 4 is a diagram illustrating an exemplary embodiment of a display panel included in a display device.

FIG. 4 is a diagram illustrating an exemplary embodiment of a display panel included in a display device.

Referring to FIG. 4, a display panel 110*a* may include a plurality of pixels RPX11 through RPX44, GPX12 through GPX45 and BPX13 through BPX46 arranged at a plurality of rows PR1 through PR4 and a plurality of columns PC1 through PC6, a plurality of first data lines DL1 respectively disposed at the plurality of columns PC1 through PC6, a plurality of second data lines DL2 respectively disposed at the plurality of columns PC1 through PC6, and a plurality of gate lines GL1 and GL2 of which the number corresponds to half of the number of the plurality of rows PR1 through PR4. Thus, in the display panel 110*a*, two data lines DL1 and DL2 are disposed per one column, and one gate line is disposed per two rows. In an exemplary embodiment, the first data line DL1 may be disposed on the left of the pixels (e.g., RPX11 through RPX41) at each column (e.g., PC1), and the second data line DL2 may be disposed on the right of the pixels (e.g., RPX11 through RPX41) at each column (e.g., PC1), for example. Further, a first gate line GL1 may be disposed between the pixels RPX11, GPX12, BPX13, RPX14, GPX15 and BPX16 at a first row PR1 and the pixels RPX21, GPX22, BPX23, RPX24, GPX25 and BPX26 at a second row PR2, and a second gate line GL2 may be disposed between the pixels RPX31, GPX32, BPX33, RPX34, GPX35 and BPX36 at a third row PR3 and the pixels RPX41, GPX42, BPX43, RPX44, GPX45 and BPX46 at a fourth row PR4.

In the display panel 110*a*, the pixels RPX11 through RPX44, GPX12 through GPX45 and BPX13 through BPX46 at each column PC1 through PC6 may be connected alternately per pixel to the first data line DL1 or to the second data line DL2. In an exemplary embodiment, with respect to the pixels RPX11 through RPX41 at a first column PC1, a first pixel RPX11 at the first row PR1 and the first column PC1 may be connected to the first data line DL1 and the first gate line GL1, a second pixel RPX21 at the second row PR2 and the first column PC1 may be connected to the second data line DL2 and the first gate line GL1, a third pixel RPX31 at the third row PR3 and the first column PC1 may be connected to the first data line DL1 and the second gate line GL2, and a fourth pixel RPX41 at the fourth row PR4 and the first column PC1 may be connected to the second data line DL2 and the second gate line GL2, for example. Further, a first data driver may apply a first gray voltage corresponding to a first gamma curve (e.g., a high gamma curve) to the first data line DL1, and a second data driver may apply a second gray voltage corresponding to a second gamma curve (e.g., a low gamma curve) to the second data line DL2. Thus, while a gate signal is applied to the first gate line GL1, the first gray voltage corresponding to the first gamma curve may be provided to the first pixel RPX11, and the second gray voltage corresponding to the second gamma curve may be provided to the second pixel RPX21. Further, while the gate signal is applied to the second gate line GL2, the first gray voltage corresponding to the first gamma curve may be provided to the third pixel RPX31, and the second gray voltage corresponding to the second gamma curve may be provided to the fourth pixel RPX41. Accordingly, the first pixel RPX11 and the third pixel RPX31 may display an image with luminance corresponding to the first gamma curve (e.g., the high gamma curve), and the second pixel RPX21 and the fourth pixel RPX41 may display an image with luminance corresponding to the second gamma curve (e.g., a low gamma curve).

In some exemplary embodiments, different color pixels (e.g., RPX11, GPX12 and BPX13) may be disposed at adjacent three columns (e.g., PC1, PC2 and PC3). In an exemplary embodiment, red pixels RPX11 through RPX41 and RPX14 through RPX44 may be disposed at the first column PC1 and a fourth column PC4, green pixels GPX12 through GPX42 and GPX15 through GPX45 may be disposed at a second column PC2 and a fifth column PC5, and blue pixels BPX13 through BPX43 and BPX16 through BPX46 may be disposed at a third column PC3 and a sixth column PC6, for example. Further, in the display panel 110*a*, the pixels (e.g., RPX11, GPX12, BPX13, RPX14, GPX15 and BPX16) disposed at each row (e.g., PR1) may be connected alternately per three pixels to the first data line DL1 or to the second data line DL2. In an exemplary embodiment, with respect to the pixels RPX11, GPX12, BPX13, RPX14, GPX15 and BPX16 at the first row PR1, the red, green and blue pixels RPX11, GPX12 and BPX13 respectively disposed at the first, second and third columns PC1, PC2 and PC3 may be connected to the plurality of first data lines DL1, and the red, green and blue pixels RPX14, GPX15 and BPX16 respectively disposed at the fourth, fifth and sixth columns PC4, PC5 and PC6 may be connected to the plurality of second data lines DL2, for example. Accordingly, the red, green and blue pixels RPX11, GPX12 and BPX13 at the first row PR1 and the first, second and third columns PC1, PC2 and PC3 may display an image with luminance corresponding to the first gamma curve (e.g., the high gamma curve), and the red, green and blue pixels RPX14, GPX15 and BPX16 at the first row PR1 and the fourth, fifth and sixth columns PC4, PC5 and PC6 may display an image with luminance corresponding to the second gamma curve (e.g., a low gamma curve). Accordingly, the side visibility may be improved without the image data modulation and the aperture ratio deterioration.

Figure 5:
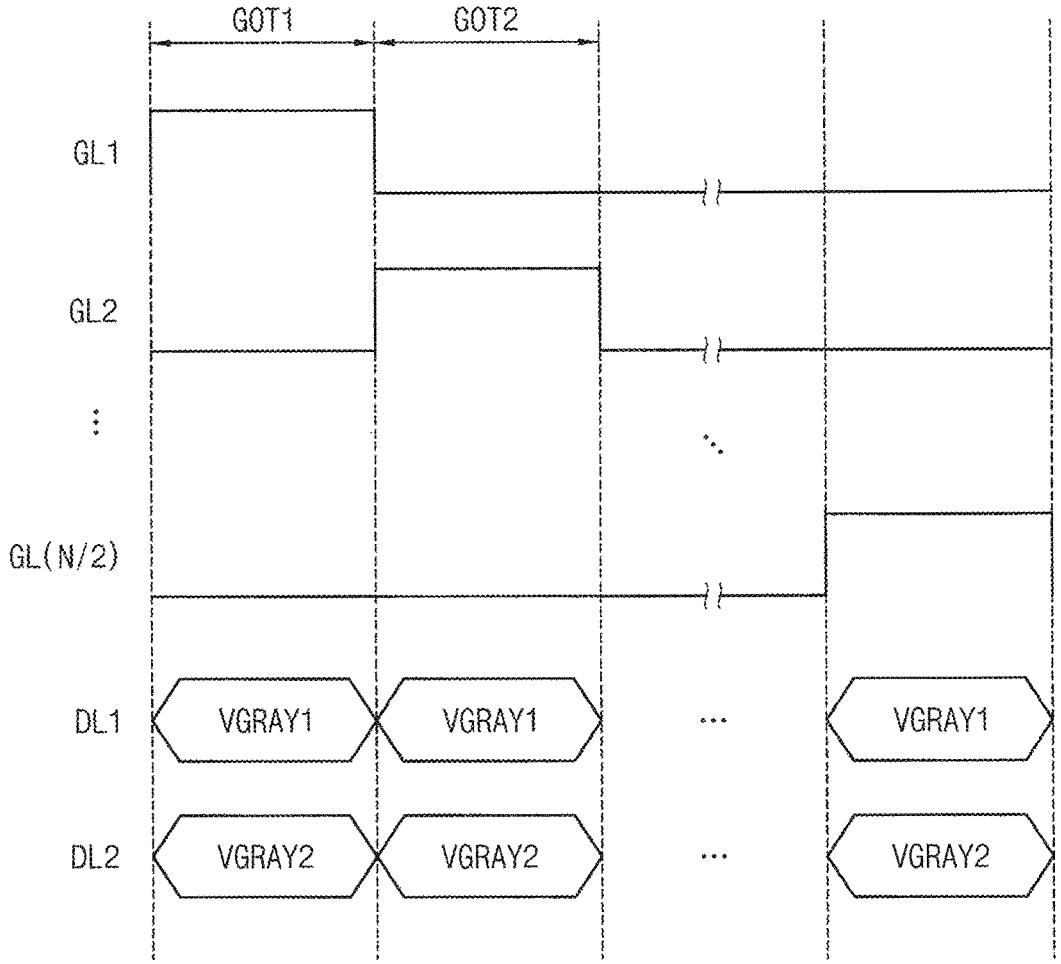
FIG. 5 is a timing diagram for describing an exemplary embodiment of an operation of a display device including a display panel of FIG. 4.
Figure 6A:
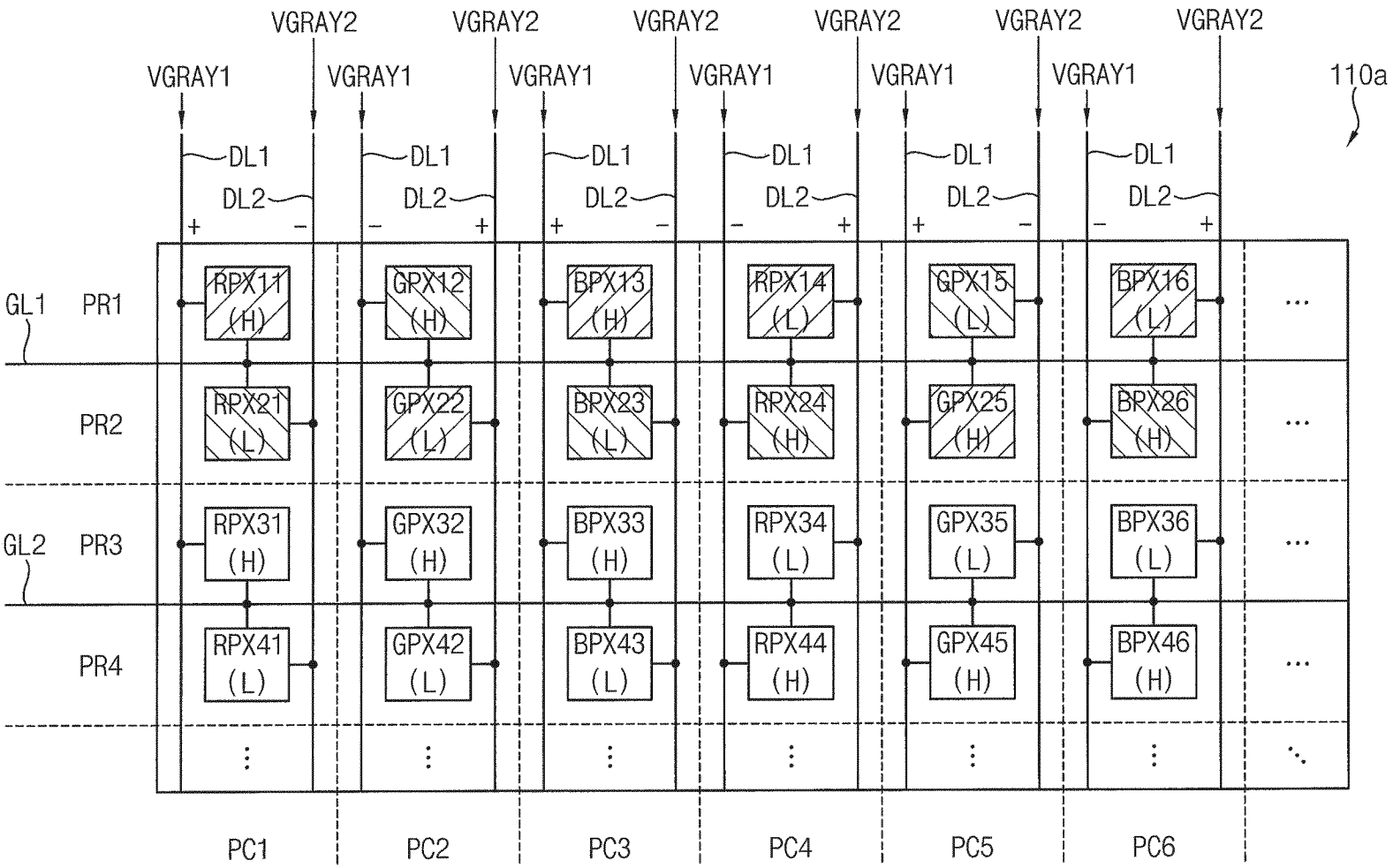
FIG. 6A is a diagram for describing an exemplary embodiment of an operation of a display panel of FIG. 4 during a first gate on time.
Figure 6B:
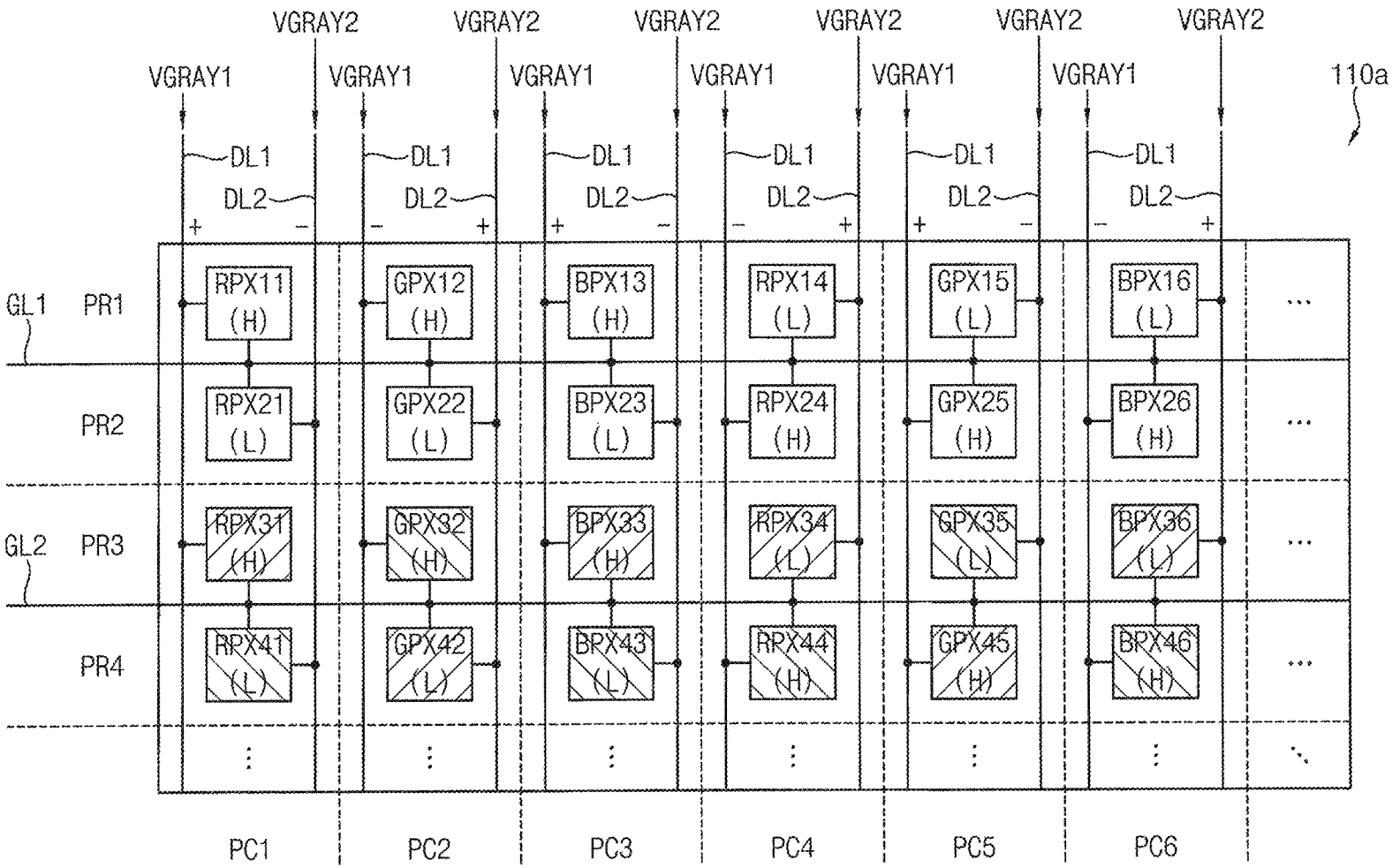
FIG. 6B is a diagram for describing an exemplary embodiment of an operation of a display panel of FIG. 4 during a second gate on time.

FIG. 5 is a timing diagram for describing an exemplary embodiment of an operation of a display device including a display panel of FIG. 4, FIG. 6A is a diagram for describing an exemplary embodiment of an operation of a display panel of FIG. 4 during a first gate on time, and FIG. 6B is a diagram for describing an exemplary embodiment of an operation of a display panel of FIG. 4 during a second gate on time.

Referring to FIGS. 4 and 5, a display panel 110*a* may include a plurality of gate lines GL1, GL2, . . . , GL(N/2) of which the number corresponds to half of the number of a plurality of rows PR1 through PR4. In an exemplary embodiment, in a case where the display panel 110*a* has N pixel rows, where N is an integer greater than 1, the display panel 110*a* may include N/2 gate lines GL1, GL2, . . . , GL(N/2), for example. In exemplary embodiments of the display panel 110*a*, as illustrated in FIG. 5, a gate signal may be sequentially applied to the plurality of gate lines GL1, GL2, . . . , GL(N/2).

During a first gate on time GOT1 when the gate signal is applied to a first gate line GL1 between a first row PR1 and a second row PR2, as illustrated in FIG. 6A, first gray voltages VGRAY1 corresponding to a first gamma curve (e.g., a high gamma curve) may be applied from a first data driver to a plurality of first data lines DL1, and second gray voltages VGRAY2 corresponding to a second gamma curve (e.g., a low gamma curve) may be applied from a second data driver to a plurality of second data lines DL2. Thus, pixels RPX11, GPX12 and BPX13 at the first row PR1 and first, second and third columns PC1, PC2 and PC3 and pixels RPX24, GPX25 and BPX26 at the second row PR2 and fourth, fifth and sixth columns PC4, PC5 and PC6 may display an image with luminance corresponding to the first gamma curve (e.g., the high gamma curve), and pixels RPX14, GPX15 and BPX16 at the first row PR1 and the fourth, fifth and sixth columns PC4, PC5 and PC6 and pixels RPX21, GPX22 and BPX23 at the second row PR2 and the first, second and third columns PC1, PC2 and PC3 may display an image with luminance corresponding to the second gamma curve (e.g., a low gamma curve).

In some exemplary embodiments, the first gray voltages VGRAY1 applied to the first data lines DL1 disposed at odd-numbered columns PC1, PC3 and PC5 may have a polarity different from that of the first gray voltages VGRAY1 applied to the first data lines DL1 disposed at even-numbered columns PC2, PC4 and PC6. Further, the second gray voltages VGRAY2 applied to the second data lines DL2 disposed at the odd-numbered columns PC1, PC3 and PC5 may have a polarity different from that of the second gray voltages VGRAY2 applied to the second data lines DL2 disposed at the even-numbered columns PC2, PC4 and PC6. In an exemplary embodiment, as illustrated in FIG. 6A, the positive first gray voltages VGRAY1 may be applied to the first data lines DL1 disposed at the odd-numbered columns PC1, PC3 and PC5, and the negative first gray voltages VGRAY1 may be applied to the first data lines DL1 disposed at the even-numbered columns PC2, PC4 and PC6, for example. Further, the negative second gray voltages VGRAY2 may be applied to the second data lines DL2 disposed at the odd-numbered columns PC1, PC3 and PC5, and the positive second gray voltages VGRAY2 may be applied to the second data lines DL2 disposed at the even-numbered columns PC2, PC4 and PC6. Accordingly, the pixels RPX11 and BPX13 at the first row PR1 and the first and third columns PC1 and PC3 and the pixel GPX25 at the second row PR2 and the fifth column PC5 may display the image based on the positive first gray voltages VGRAY1, the pixel GPX12 at the first row PR1 and the second column PC2 and the pixels RPX24 and BPX26 at the second row PR2 and the fourth and sixth columns PC4 and PC6 may display the image based on the negative first gray voltages VGRAY1, the pixels RPX14 and BPX16 at the first row PR1 and the fourth and sixth columns PC4 and PC6 and the pixel GPX22 at the second row PR2 and the second column PC2 may display the image based on the positive second gray voltages VGRAY2, and the pixel GPX15 at the first row PR1 and the fifth column PC5 and the pixels RPX21 and BPX23 at the second row PR2 and the first and third columns PC1 and PC3 may display the image based on the negative second gray voltages VGRAY2.

After the first gate on time GOT1, during a second gate on time GOT2 when the gate signal is applied to a second gate line GL2 between a third row PR3 and a fourth row PR4, as illustrated in FIG. 6B, the positive first gray voltages VGRAY1 may be applied to the first data lines DL1 disposed at the odd-numbered columns PC1, PC3 and PC5, the negative first gray voltages VGRAY1 may be applied to the first data lines DL1 disposed at the even-numbered columns PC2, PC4 and PC6, the negative second gray voltages VGRAY2 may be applied to the second data lines DL2 disposed at the odd-numbered columns PC1, PC3 and PC5, and the positive second gray voltages VGRAY2 may be applied to the second data lines DL2 disposed at the even-numbered columns PC2, PC4 and PC6. Accordingly, pixels RPX31 and BPX33 at the third row PR3 and the first and third columns PC1 and PC3 and a pixel GPX45 at the fourth row PR4 and the fifth column PC5 may display the image with luminance corresponding to the first gamma curve based on the positive first gray voltages VGRAY1, a pixel GPX32 at the third row PR3 and the second column PC2 and pixels RPX44 and BPX46 at the fourth row PR4 and the fourth and sixth columns PC4 and PC6 may display the image with luminance corresponding to the first gamma curve based on the negative first gray voltages VGRAY1, pixels RPX34 and BPX36 at the third row PR3 and the fourth and sixth columns PC4 and PC6 and a pixel GPX42 at the fourth row PR4 and the second column PC2 may display the image with luminance corresponding to the second gamma curve based on the positive second gray voltages VGRAY2, and a pixel GPX35 at the third row PR3 and the fifth column PC5 and pixels RPX41 and BPX43 at the fourth row PR4 and the first and third columns PC1 and PC3 may display the image with luminance corresponding to the second gamma curve based on the negative second gray voltages VGRAY2.

In this manner, the positive/negative first gray voltages VGRAY1 and the positive/negative second gray voltages VGRAY2 may be applied to all the pixels RPX11 through RPX44, GPX12 through GPX45 and BPX13 through BPX46 of the display panel 110*a*, and thus, without the aperture ratio deterioration caused by dividing a unit pixel into two sub-pixels, and without the image data modulation, a side visibility of the display panel 110*a* may be improved. In some exemplary embodiments, the polarity of the gray voltage VGRAY1 or VGRAY2 applied to each data line DL1 or DL2 may be inverted per frame.

Figure 7:
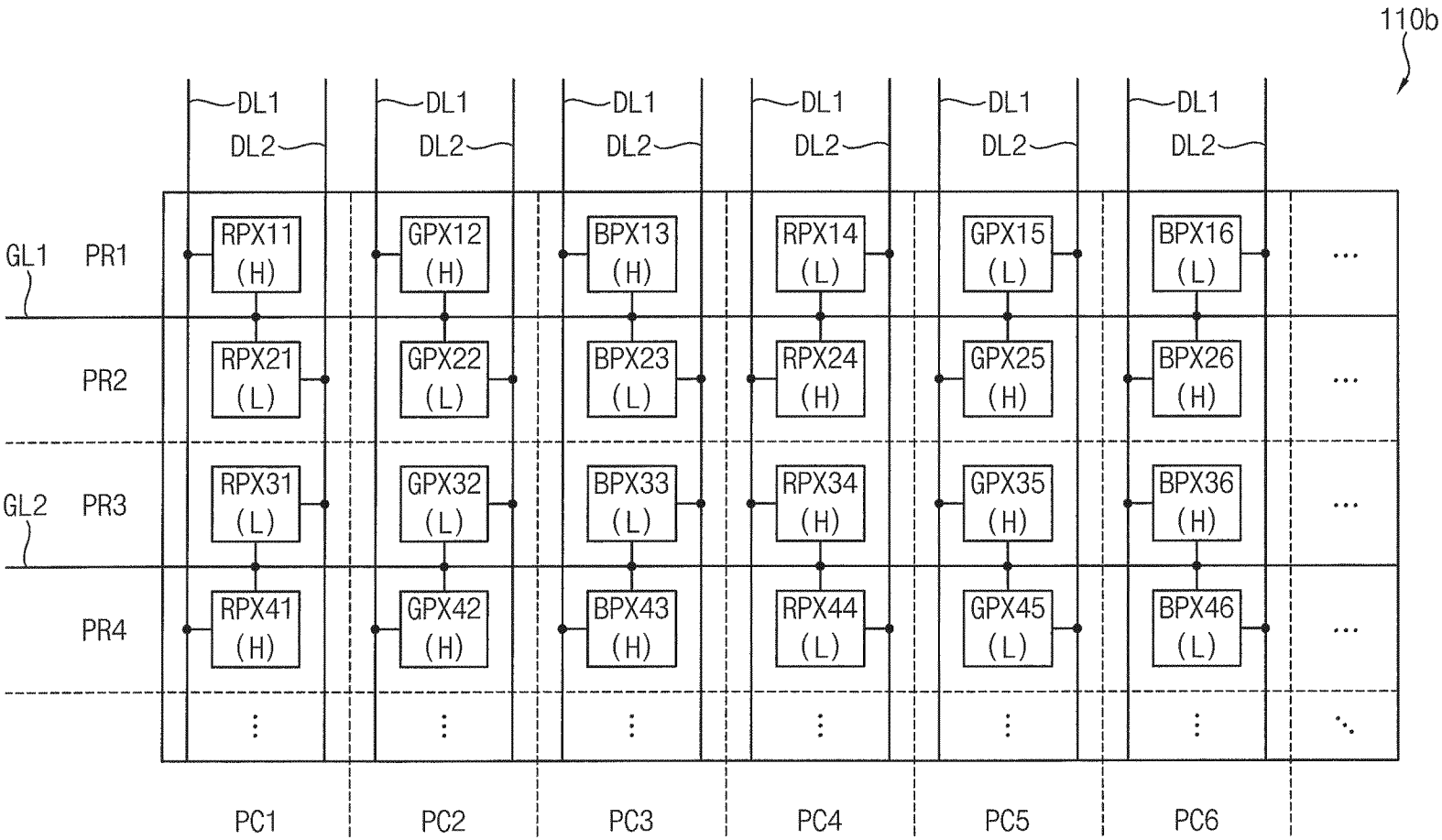
FIG. 7 is a diagram illustrating an exemplary embodiment of a display panel included in a display device.

FIG. 7 is a diagram illustrating a display panel included in a display device.

Referring to FIG. 7, a display panel 110*b* may include a plurality of pixels RPX11 through RPX44, GPX12 through GPX45 and BPX13 through BPX46 arranged at a plurality of rows PR1 through PR4 and a plurality of columns PC1 through PC6, a plurality of first data lines DL1 respectively disposed at the plurality of columns PC1 through PC6, a plurality of second data lines DL2 respectively disposed at the plurality of columns PC1 through PC6, and a plurality of gate lines GL1 and GL2 of which the number corresponds to half of the number of the plurality of rows PR1 through PR4.

In the display panel 110*b*, the pixels RPX11 through RPX44, GPX12 through GPX45 and BPX13 through BPX46 at each column PC1 through PC6 may be connected alternately per two pixels to the first data line DL1 or to the second data line DL2. In an exemplary embodiment, with respect to the pixels RPX11 through RPX41 at a first column PC1, a first pixel RPX11 at a first row PR1 and a first column PC1 may be connected to the first data line DL1 and a first gate line GL1, a second pixel RPX21 at a second row PR2 and the first column PC1 may be connected to the second data line DL2 and the first gate line GL1, a third pixel RPX31 at a third row PR3 and the first column PC1 may be connected to the second data line DL2 and the second gate line GL2, and a fourth pixel RPX41 at a fourth row PR4 and the first column PC1 may be connected to the first data line DL1 and the second gate line GL2, for example. Accordingly, the first pixel RPX11 and the fourth pixel RPX41 may display an image with luminance corresponding to a first gamma curve (e.g., a high gamma curve), and the second pixel RPX21 and the third pixel RPX31 may display an image with luminance corresponding to a second gamma curve (e.g., a low gamma curve) different from the first gamma curve. Accordingly, the side visibility may be improved without the image data modulation and the aperture ratio deterioration.

Figure 8A:
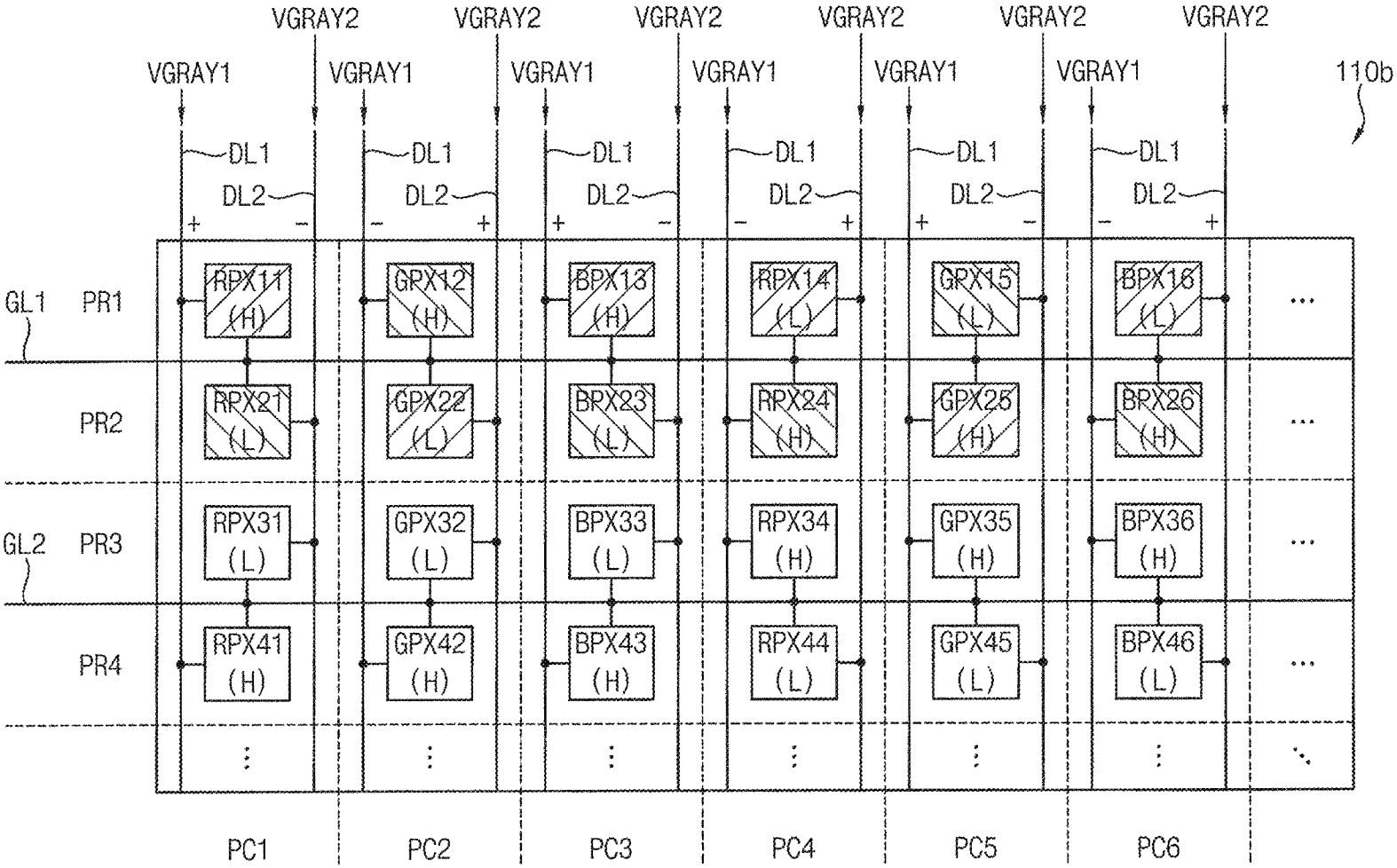
FIG. 8A is a diagram for describing an exemplary embodiment of an operation of a display panel of FIG. 7 during a first gate on time.
Figure 8B:
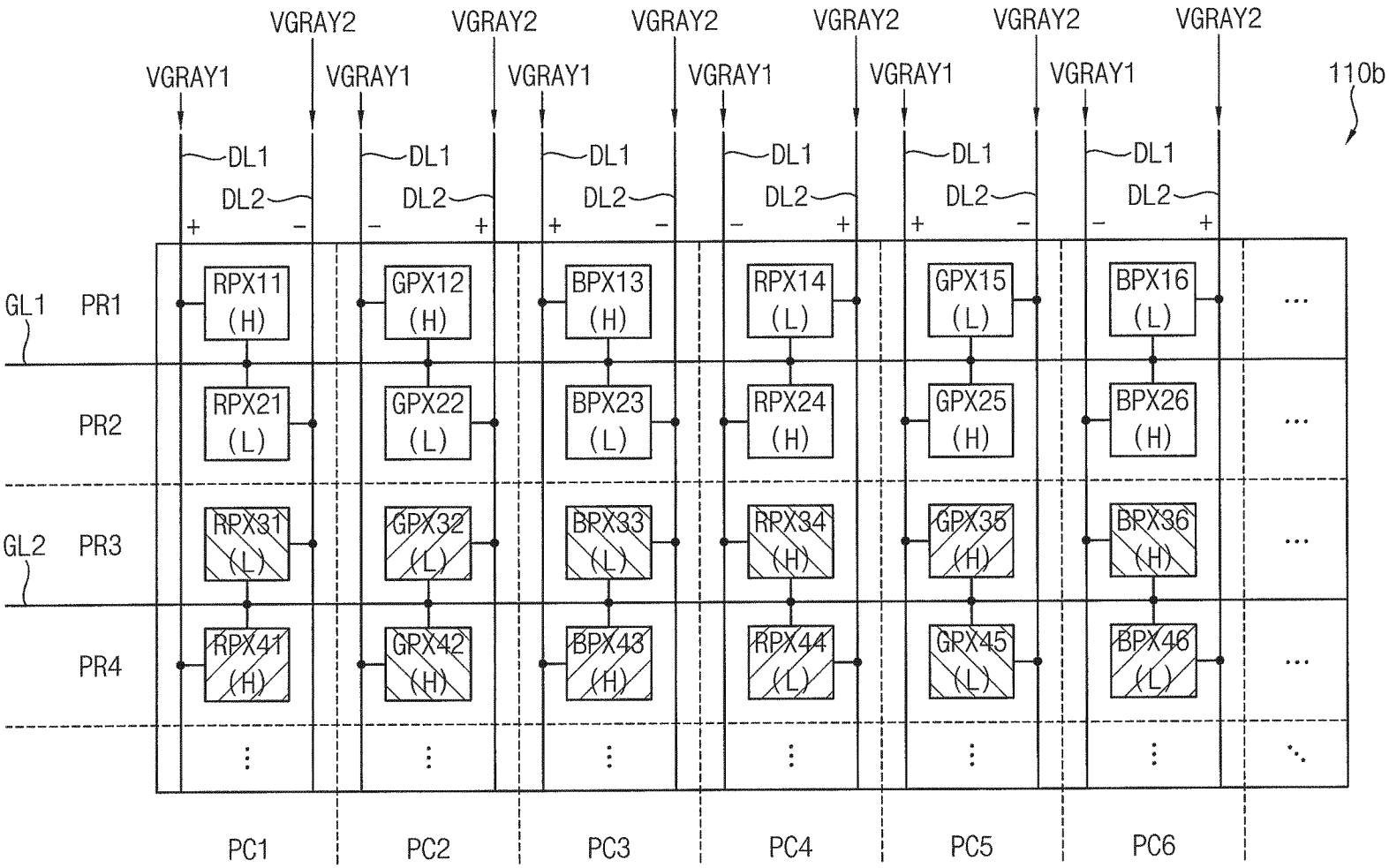
FIG. 8B is a diagram for describing an exemplary embodiment of an operation of a display panel of FIG. 7 during a second gate on time.

FIG. 8A is a diagram for describing an exemplary embodiment of an operation of a display panel of FIG. 7 during a first gate on time, and FIG. 8B is a diagram for describing an exemplary embodiment of an operation of a display panel of FIG. 7 during a second gate on time.

Referring to FIGS. 5, 7, 8A and 8B, in exemplary embodiments of a display panel 110*b*, as illustrated in FIG. 4, a gate signal may be sequentially applied to a plurality of gate lines GL1, GL2, . . . , GL(N/2).

During a first gate on time GOT1, as illustrated in FIG. 8A, positive first gray voltages VGRAY1 may be applied to first data lines DL1 disposed at odd-numbered columns PC1, PC3 and PC5, negative first gray voltages VGRAY1 may be applied to first data lines DL1 disposed at even-numbered columns PC2, PC4 and PC6, negative second gray voltages VGRAY2 may be applied to second data lines DL2 disposed at the odd-numbered columns PC1, PC3 and PC5, and positive second gray voltages VGRAY2 may be applied to the second data lines DL2 disposed at the even-numbered columns PC2, PC4 and PC6. Accordingly, pixels RPX11 and BPX13 at a first row PR1 and the first and third columns PC1 and PC3 and a pixel GPX25 at a second row PR2 and the fifth column PC5 may display an image corresponding to a first gamma curve based on the positive first gray voltages VGRAY1, a pixel GPX12 at the first row PR1 and the second column PC2 and pixels RPX24 and BPX26 at the second row PR2 and the fourth and sixth columns PC4 and PC6 may display an image corresponding to the first gamma curve based on the negative first gray voltages VGRAY1, pixels RPX14 and BPX16 at the first row PR1 and the fourth and sixth columns PC4 and PC6 and a pixel GPX22 at the second row PR2 and the second column PC2 may display an image corresponding to a second gamma curve based on the positive second gray voltages VGRAY2, and a pixel GPX15 at the first row PR1 and the fifth column PC5 and pixels RPX21 and BPX23 at the second row PR2 and the first and third columns PC1 and PC3 may display an image corresponding to the second gamma curve based on the negative second gray voltages VGRAY2.

Further, during a second gate on time GOT2 after the first gate on time GOT1, as illustrated in FIG. 8B, the positive first gray voltages VGRAY1 may be applied to the first data lines DL1 disposed at the odd-numbered columns PC1, PC3 and PC5, the negative first gray voltages VGRAY1 may be applied to the first data lines DL1 disposed at the even-numbered columns PC2, PC4 and PC6, the negative second gray voltages VGRAY2 may be applied to the second data lines DL2 disposed at the odd-numbered columns PC1, PC3 and PC5, and the positive second gray voltages VGRAY2 may be applied to the second data lines DL2 disposed at the even-numbered columns PC2, PC4 and PC6. Accordingly, a pixel GPX35 at a third row PR3 and the fifth column PC5 and pixels RPX41 and BPX43 at a fourth row PR4 and the first and third columns PC1 and PC3 may display an image with luminance corresponding to the first gamma curve based on the positive first gray voltages VGRAY1, pixels RPX34 and BPX36 at the third row PR3 and the fourth and sixth columns PC4 and PC6 and pixel GPX42 at the fourth row PR4 and the second column PC2 may display an image with luminance corresponding to the first gamma curve based on the negative first gray voltages VGRAY1, a pixel GPX32 at the third row PR3 and the second column PC2 and pixels RPX44 and BPX46 at the fourth row PR4 and the fourth and sixth columns PC4 and PC6 may display an image with luminance corresponding to the second gamma curve based on the positive second gray voltages VGRAY2, and pixels RPX31 and BPX33 at the third row PR3 and the first and third columns PC1 and PC3 and a pixel GPX45 at the fourth row PR4 and the fifth column PC5 may display an image with luminance corresponding to the second gamma curve based on the negative second gray voltages VGRAY2.

In this manner, the positive/negative first gray voltages VGRAY1 and the positive/negative second gray voltages VGRAY2 may be applied to all the pixels RPX11 through RPX44, GPX12 through GPX45 and BPX13 through BPX46 of the display panel 110*b*, and thus, without the aperture ratio deterioration caused by dividing a unit pixel into two sub-pixels, and without the image data modulation, a side visibility of the display panel 110*b* may be improved.

Figure 9:
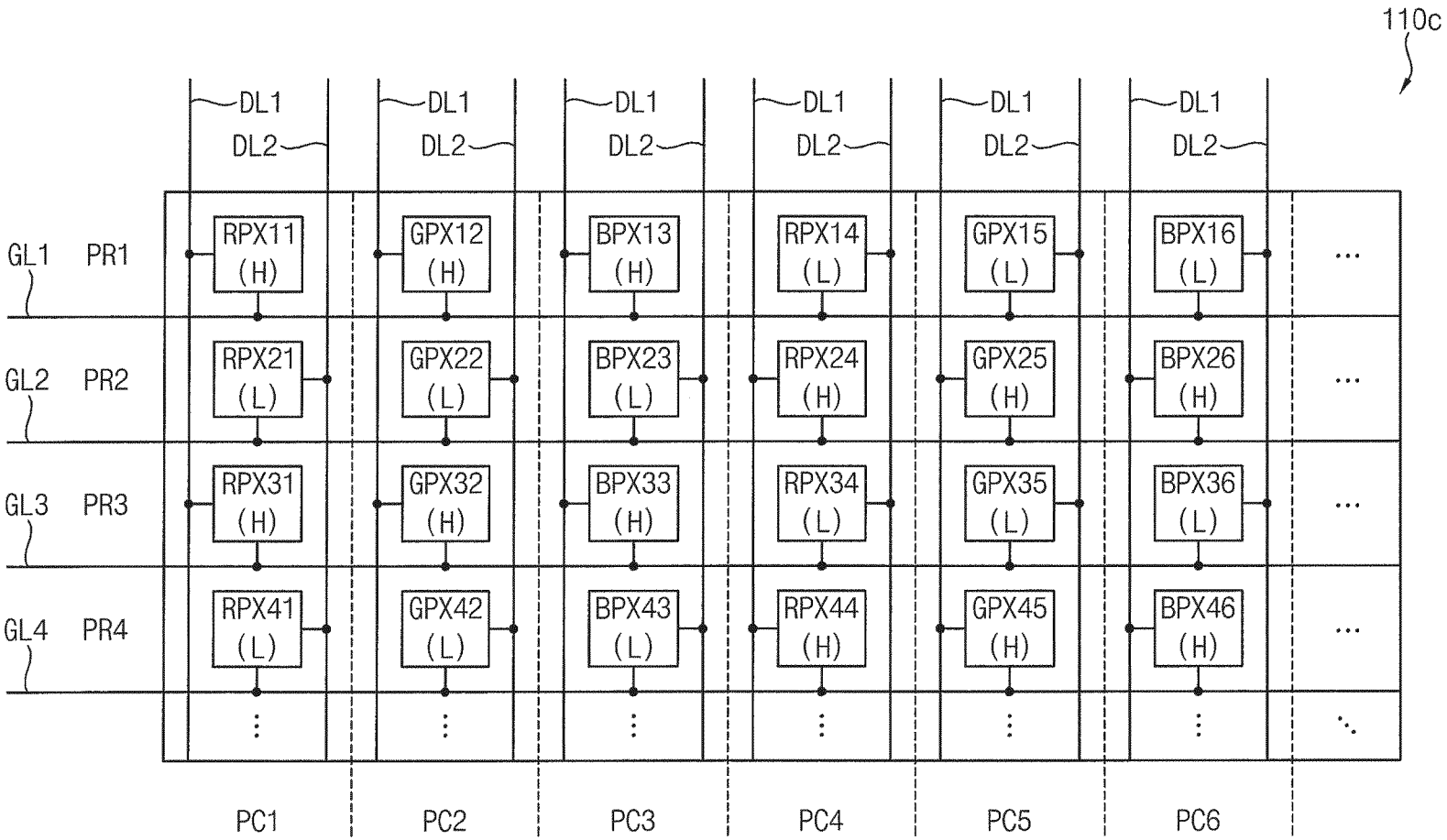
FIG. 9 is a diagram illustrating a display panel included in a display device.

FIG. 9 is a diagram illustrating an exemplary embodiment of a display panel included in a display device.

Referring to FIG. 9, a display panel 110*c* may include a plurality of pixels RPX11 through RPX44, GPX12 through GPX45 and BPX13 through BPX46 arranged at a plurality of rows PR1 through PR4 and a plurality of columns PC1 through PC6, a plurality of first data lines DL1 respectively disposed at the plurality of columns PC1 through PC6, a plurality of second data lines DL2 respectively disposed at the plurality of columns PC1 through PC6, and a plurality of gate lines GL1 through GL4 respectively disposed at the plurality of rows PR1 through PR4. Thus, in the display panel 110*c*, unlike the display panels 110*a* and 110*b* of FIGS. 4 and 7, one gate line may be disposed per one row. In an exemplary embodiment, a first gate line GL1 may be disposed at a first row PR1, a second gate line GL2 may be disposed at a second row PR2, a third gate line GL3 may be disposed at a third row PR3, and a fourth gate line GL4 may be disposed at a fourth row PR4, for example.

In the display panel 110*c*, the pixels RPX11 through RPX44, GPX12 through GPX45 and BPX13 through BPX46 at each column PC1 through PC6 may be connected alternately per pixel to the first data line DL1 or to the second data line DL2. In an exemplary embodiment, with respect to the pixels RPX11 through RPX41 at a first column PC1, a first pixel RPX11 at the first row PR1 and a first column PC1 may be connected to the first data line DL1 and the first gate line GL1, a second pixel RPX21 at the second row PR2 and the first column PC1 may be connected to the second data line DL2 and the second gate line GL2, a third pixel RPX31 at the third row PR3 and the first column PC1 may be connected to the first data line DL1 and the third gate line GL3, and a fourth pixel RPX41 at the fourth row PR4 and the first column PC1 may be connected to the second data line DL2 and the fourth gate line GL4, for example. Further, a first data driver may apply a first gray voltage corresponding to a first gamma curve (e.g., a high gamma curve) to the first data line DL1, and a second data driver may apply a second gray voltage corresponding to a second gamma curve (e.g., a low gamma curve) to the second data line DL2. Thus, the first gray voltage corresponding to the first gamma curve may be provided to the first pixel RPX11 while a gate signal is applied to the first gate line GL1, the second gray voltage corresponding to the second gamma curve may be provided to the second pixel RPX12 while the gate signal is applied to the second gate line GL2, the first gray voltage corresponding to the first gamma curve may be provided to the third pixel RPX13 while the gate signal is applied to the third gate line GL3, and the second gray voltage corresponding to the second gamma curve may be provided to the fourth pixel RPX14 while the gate signal is applied to the fourth gate line GL4. Accordingly, the first pixel RPX11 and the third pixel RPX31 may display an image with luminance corresponding to the first gamma curve (e.g., the high gamma curve), and the second pixel RPX21 and the fourth pixel RPX41 may display an image with luminance corresponding to the second gamma curve (e.g., a low gamma curve). Accordingly, the side visibility may be improved without the image data modulation and the aperture ratio deterioration.

Figure 10:
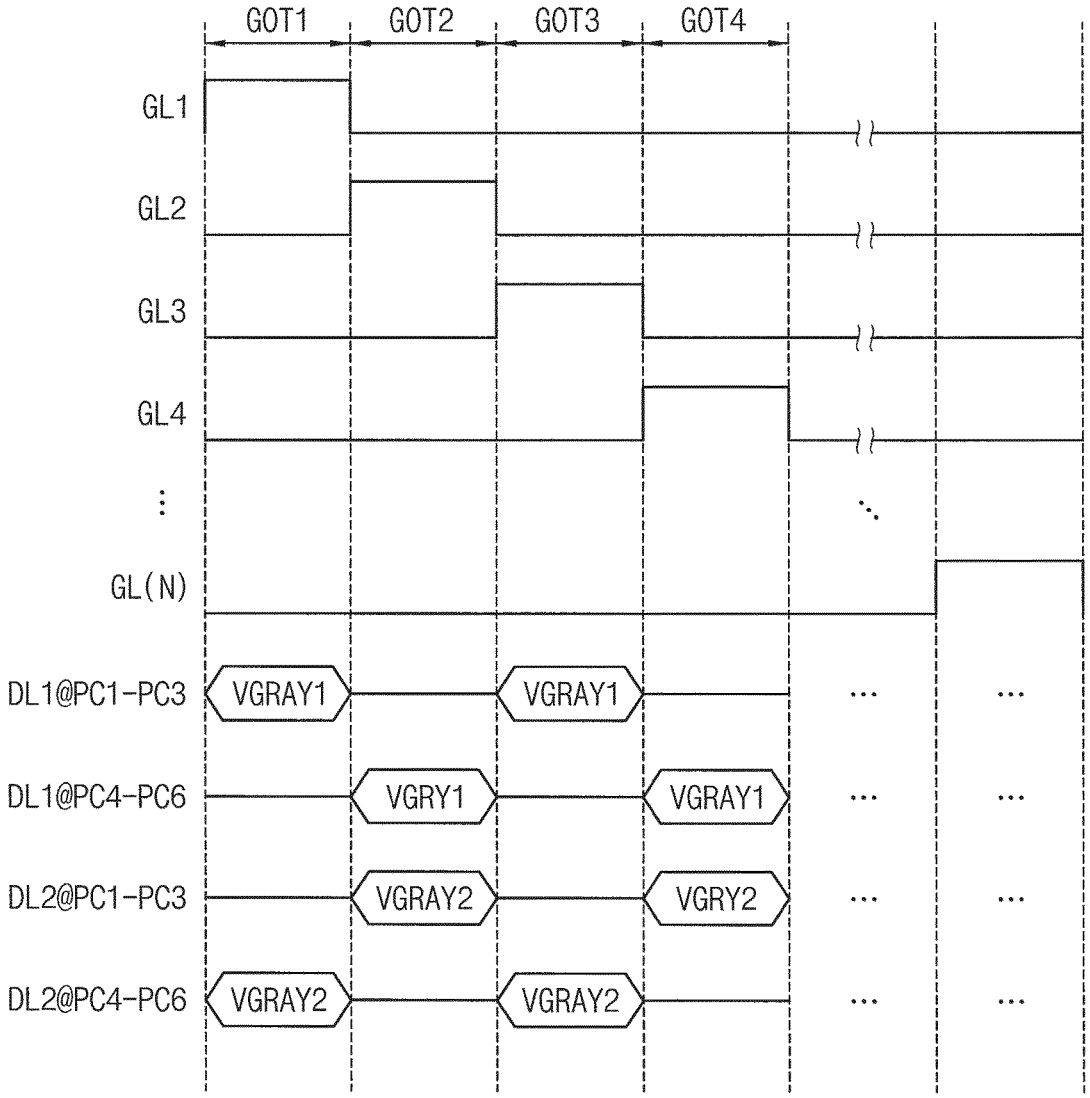
FIG. 10 is a timing diagram for describing an exemplary embodiment of an operation of a display device including a display panel of FIG. 9.
Figure 11A:
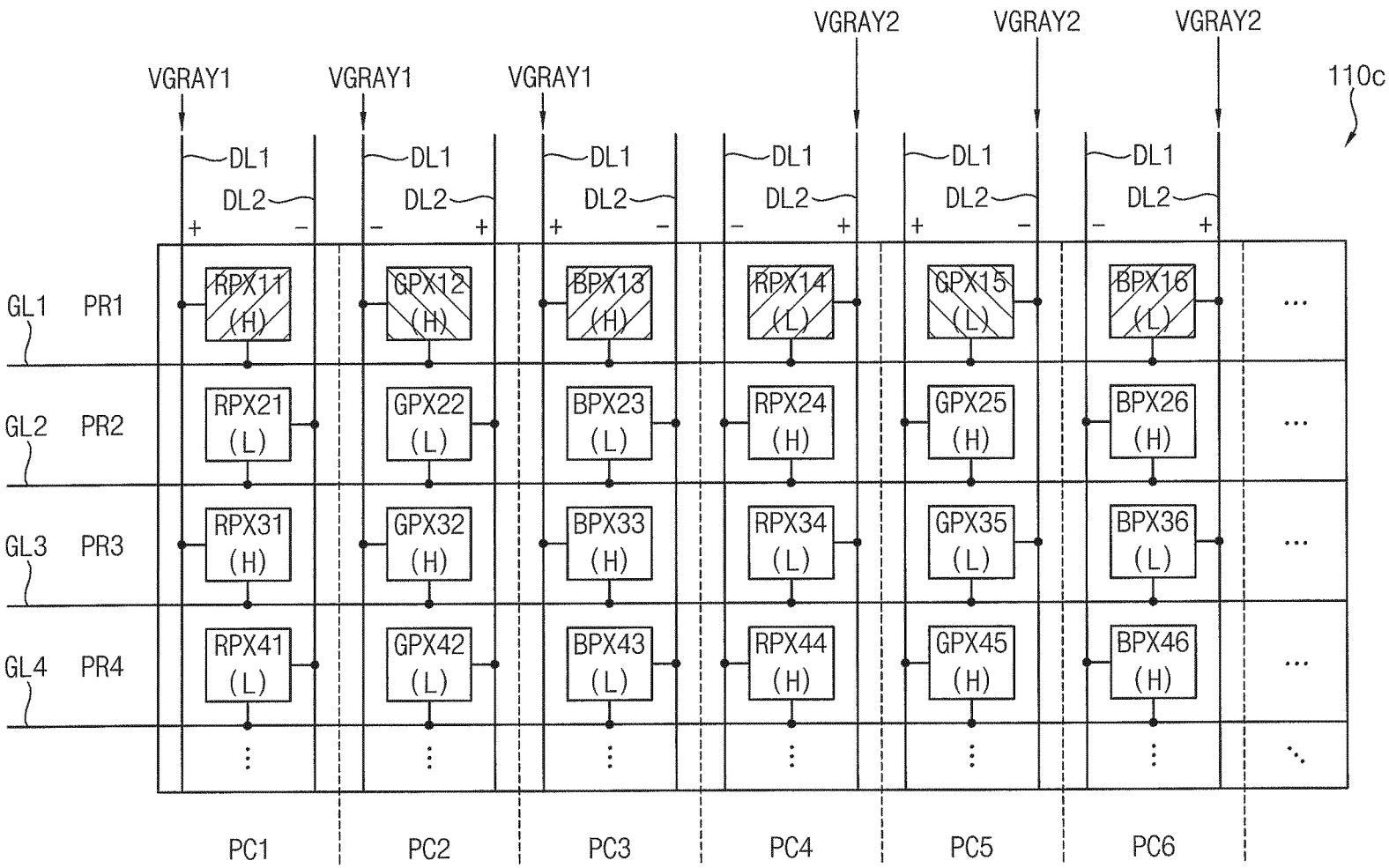
FIG. 11A is a diagram for describing an exemplary embodiment of an operation of a display panel of FIG. 9 during a first gate on time.
Figure 11B:
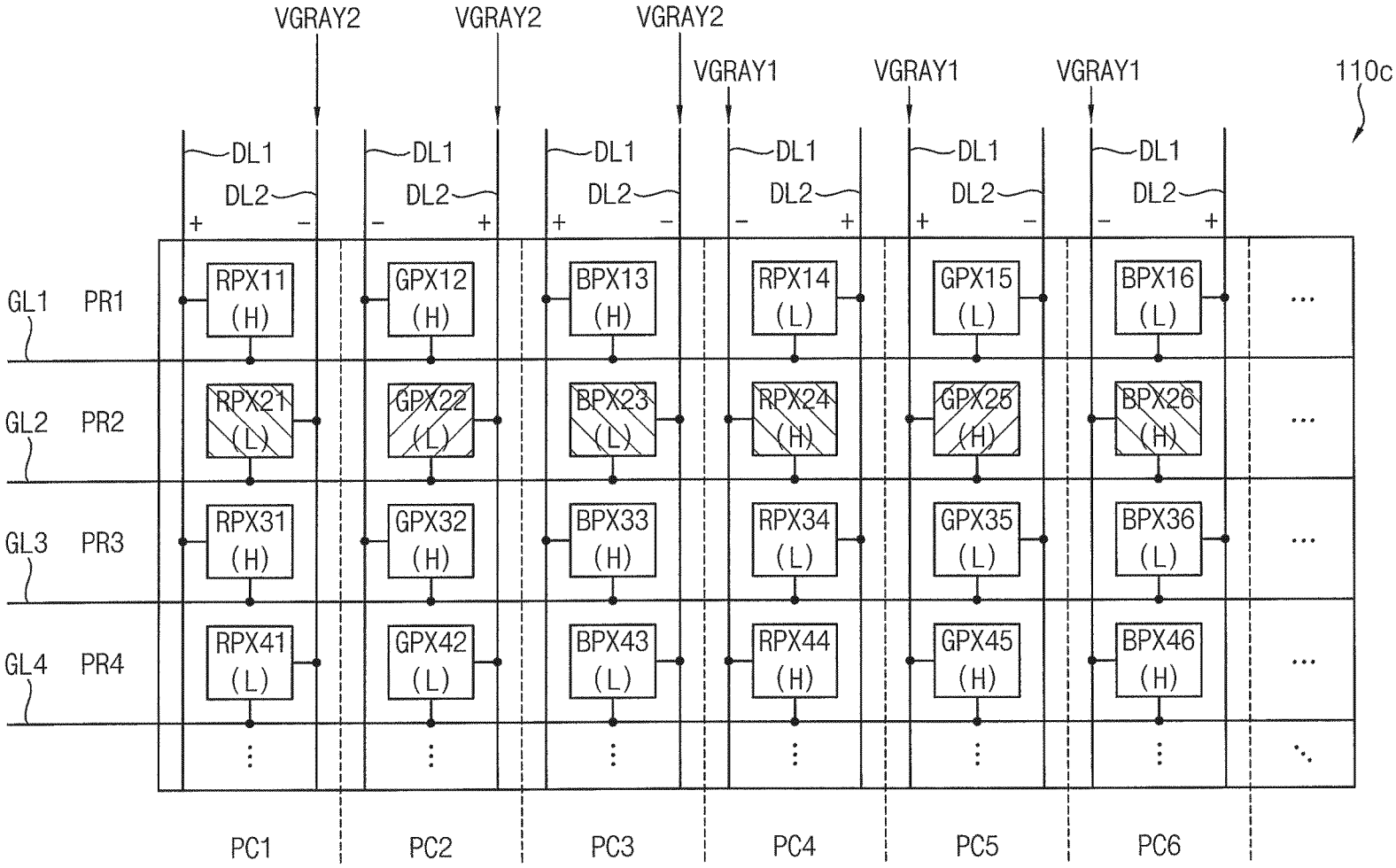
FIG. 11B is a diagram for describing an exemplary embodiment of an operation of a display panel of FIG. 9 during a second gate on time.
Figure 11C:
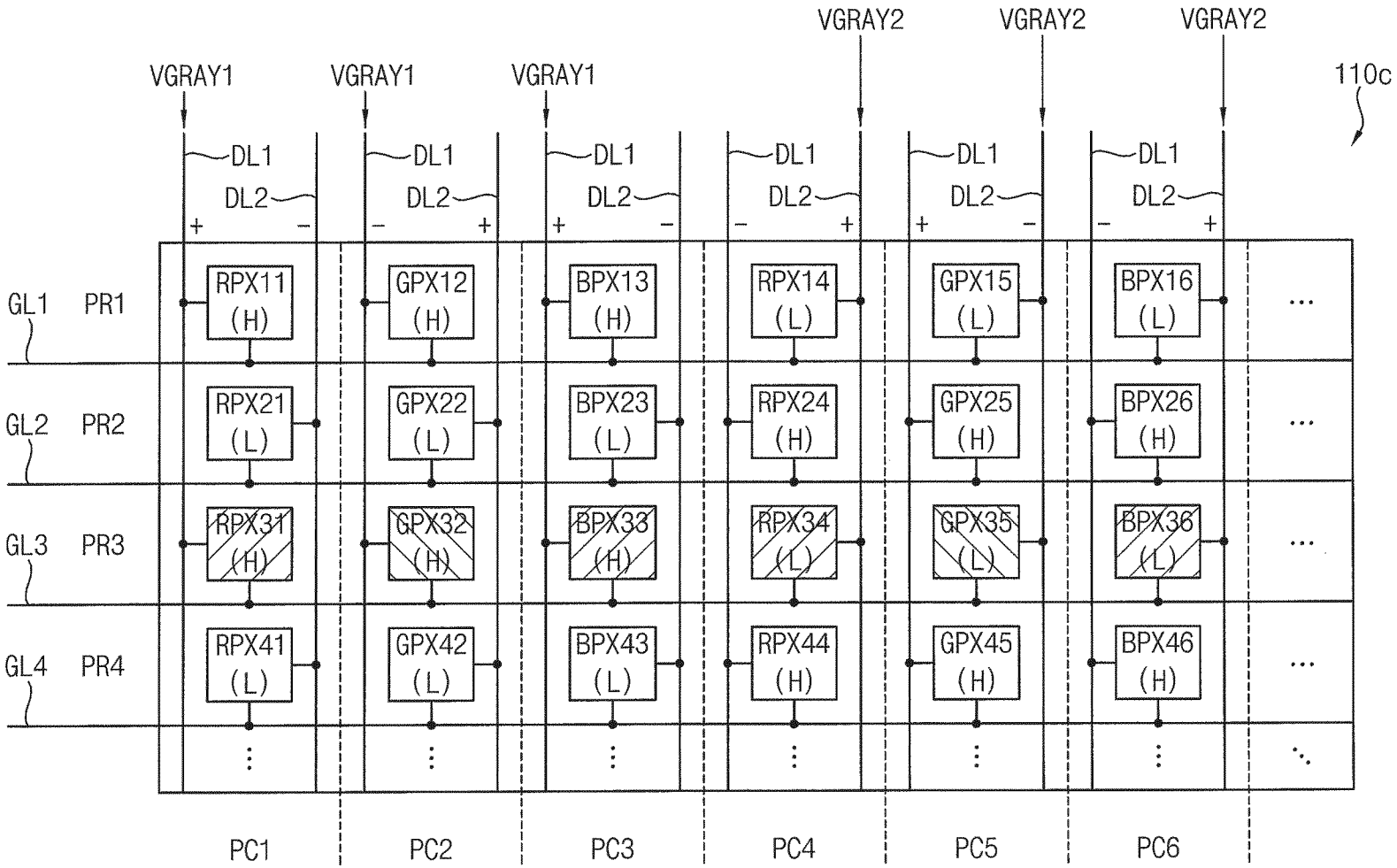
FIG. 11C is a diagram for describing an exemplary embodiment of an operation of a display panel of FIG. 9 during a third gate on time.
Figure 11D:
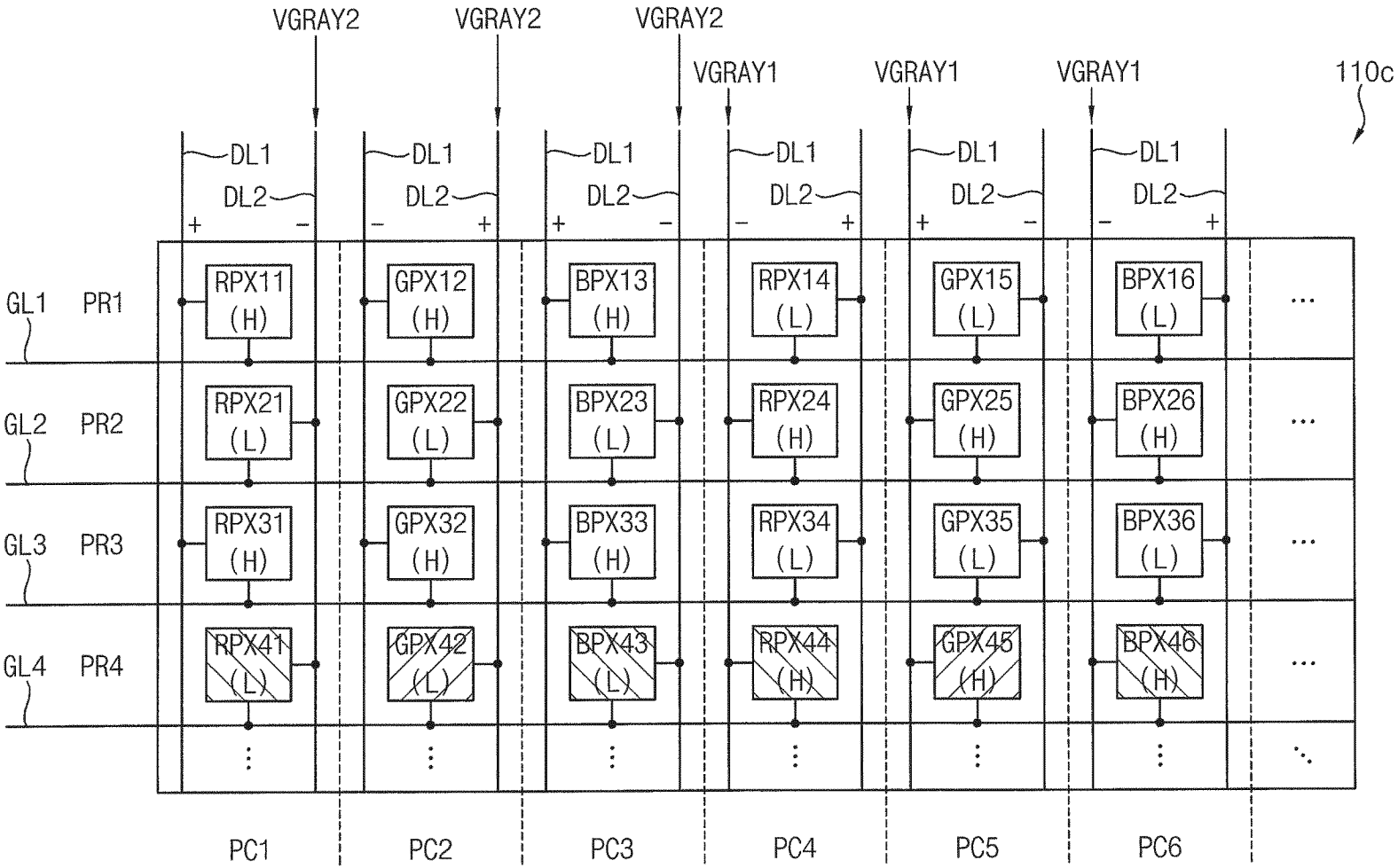
FIG. 11D is a diagram for describing an exemplary embodiment of an operation of a display panel of FIG. 9 during a fourth gate on time.

FIG. 10 is a timing diagram for describing an exemplary embodiment of an operation of a display device including a display panel of FIG. 9, FIG. 11A is a diagram for describing an exemplary embodiment of an operation of a display panel of FIG. 9 during a first gate on time, FIG. 11B is a diagram for describing an exemplary embodiment of an operation of a display panel of FIG. 9 during a second gate on time, FIG. 11C is a diagram for describing an exemplary embodiment of an operation of a display panel of FIG. 9 during a third gate on time, and FIG. 11D is a diagram for describing an exemplary embodiment of an operation of a display panel of FIG. 9 during a fourth gate on time.

Referring to FIGS. 9 and 10, a display panel 110*c* may include a plurality of gate lines GL1, GL2, . . . , GL(N) of which the number corresponds to the number of a plurality of rows PR1 through PR4. In an exemplary embodiment, in a case where the display panel 110*c* has N pixel rows, where N is an integer greater than 1, the display panel 110*c* may include N gate lines GL1, GL2, . . . , GL(N), for example. In exemplary embodiments of the display panel 110*c*, as illustrated in FIG. 10, a gate signal may be sequentially applied to the plurality of gate lines GL1, GL2, . . . , GL(N).

During a first gate on time GOT1 when the gate signal is applied to a first gate line GL1 at a first row PR1, as illustrated in FIG. 11A, first gray voltages VGRAY1 corresponding to a first gamma curve (e.g., a high gamma curve) may be applied to a plurality of first data lines DL1 disposed at first, second and third columns PC1, PC2 and PC3, and second gray voltages VGRAY2 corresponding to a second gamma curve (e.g., a low gamma curve) may be applied to a plurality of second data lines DL2 at fourth, fifth and sixth columns PC4, PC5 and PC6. In some exemplary embodiments, as illustrated in FIG. 11A, the positive first gray voltages VGRAY1 may be applied to the first data lines DL1 disposed at the first and third columns PC1 and PC3, the negative first gray voltage VGRAY1 may be applied to the first data line DL1 disposed at the second columns PC2, the positive second gray voltages VGRAY2 may be applied to the second data lines DL2 disposed at the fourth and sixth columns PC4 and PC6, and the negative second gray voltage VGRAY2 may be applied to the second data line DL2 disposed at the fifth columns PC5. Accordingly, pixels RPX11 and BPX13 at the first row PR1 and the first and third columns PC1 and PC3 may display an image with luminance corresponding to the first gamma curve based on the positive first gray voltages VGRAY1, a pixel GPX12 at the first row PR1 and the second column PC2 may display an image with luminance corresponding to the first gamma curve based on the negative first gray voltage VGRAY1, pixels RPX14 and BPX16 at the first row PR1 and the fourth and sixth columns PC4 and PC6 may display an image with luminance corresponding to the second gamma curve based on the positive second gray voltages VGRAY2, and a pixel GPX15 at the first row PR1 and the fifth column PC5 may display an image with luminance corresponding to the second gamma curve based on the negative second gray voltage VGRAY2.

During a second gate on time GOT2 when the gate signal is applied to a second gate line GL2 at a second row PR2, as illustrated in FIG. 11B, the negative second gray voltages VGRAY2 may be applied to the second data lines DL2 disposed at the first and third columns PC1 and PC3, the positive second gray voltage VGRAY2 may be applied to the second data line DL2 disposed at the second columns PC2, the negative first gray voltages VGRAY1 may be applied to the first data lines DL1 disposed at the fourth and sixth columns PC4 and PC6, and the positive first gray voltage VGRAY1 may be applied to the first data line DL1 disposed at the fifth columns PC5. Accordingly, pixels RPX21 and BPX23 at the second row PR2 and the first and third columns PC1 and PC3 may display an image with luminance corresponding to the second gamma curve based on the negative second gray voltages VGRAY2, a pixel GPX22 at the second row PR2 and the second column PC2 may display an image with luminance corresponding to the second gamma curve based on the positive second gray voltage VGRAY2, pixels RPX24 and BPX26 at the second row PR2 and the fourth and sixth columns PC4 and PC6 may display an image with luminance corresponding to the first gamma curve based on the negative first gray voltages VGRAY1, and a pixel GPX25 at the second row PR2 and the fifth column PC5 may display an image with luminance corresponding to the first gamma curve based on the positive first gray voltage VGRAY1.

During a third gate on time GOT3 when the gate signal is applied to a third gate line GL3 at a third row PR3, as illustrated in FIG. 11C, the positive first gray voltages VGRAY1 may be applied to the first data lines DL1 disposed at the first and third columns PC1 and PC3, the negative first gray voltage VGRAY1 may be applied to the first data line DL1 disposed at the second columns PC2, the positive second gray voltages VGRAY2 may be applied to the second data lines DL2 disposed at the fourth and sixth columns PC4 and PC6, and the negative second gray voltage VGRAY2 may be applied to the second data line DL2 disposed at the fifth columns PC5. Accordingly, pixels RPX31 and BPX33 at the third row PR3 and the first and third columns PC1 and PC3 may display an image with luminance corresponding to the first gamma curve based on the positive first gray voltages VGRAY1, a pixel GPX32 at the third row PR3 and the second column PC2 may display an image with luminance corresponding to the first gamma curve based on the negative first gray voltage VGRAY1, pixels RPX34 and BPX36 at the third row PR3 and the fourth and sixth columns PC4 and PC6 may display an image with luminance corresponding to the second gamma curve based on the positive second gray voltages VGRAY2, and a pixel GPX35 at the third row PR3 and the fifth column PC5 may display an image with luminance corresponding to the second gamma curve based on the negative second gray voltage VGRAY2.

During a fourth gate on time GOT4 when the gate signal is applied to a fourth gate line GL4 at a fourth row PR4, as illustrated in FIG. 11D, the negative second gray voltages VGRAY2 may be applied to the second data lines DL2 disposed at the first and third columns PC1 and PC3, the positive second gray voltage VGRAY2 may be applied to the second data line DL2 disposed at the second columns PC2, the negative first gray voltages VGRAY1 may be applied to the first data lines DL1 disposed at the fourth and sixth columns PC4 and PC6, and the positive first gray voltage VGRAY1 may be applied to the first data line DL1 disposed at the fifth columns PC5. Accordingly, pixels RPX41 and BPX43 at the fourth row PR4 and the first and third columns PC1 and PC3 may display an image with luminance corresponding to the second gamma curve based on the negative second gray voltages VGRAY2, a pixel GPX42 at the fourth row PR4 and the second column PC2 may display an image with luminance corresponding to the second gamma curve based on the positive second gray voltage VGRAY2, pixels RPX44 and BPX46 at the fourth row PR4 and the fourth and sixth columns PC4 and PC6 may display an image with luminance corresponding to the first gamma curve based on the negative first gray voltages VGRAY1, and a pixel GPX45 at the fourth row PR4 and the fifth column PC5 may display an image with luminance corresponding to the first gamma curve based on the positive first gray voltage VGRAY1.

In this manner, the positive/negative first gray voltages VGRAY1 and the positive/negative second gray voltages VGRAY2 may be applied to all the pixels RPX11 through RPX44, GPX12 through GPX45 and BPX13 through BPX46 of the display panel 110*c*, and thus, without the aperture ratio deterioration caused by dividing a unit pixel into two sub-pixels, and without the image data modulation, a side visibility of the display panel 110*c* may be improved. In some exemplary embodiments, the polarity of the gray voltage VGRAY1 or VGRAY2 applied to each data line DL1 or DL2 may be inverted per frame.

Figure 12:
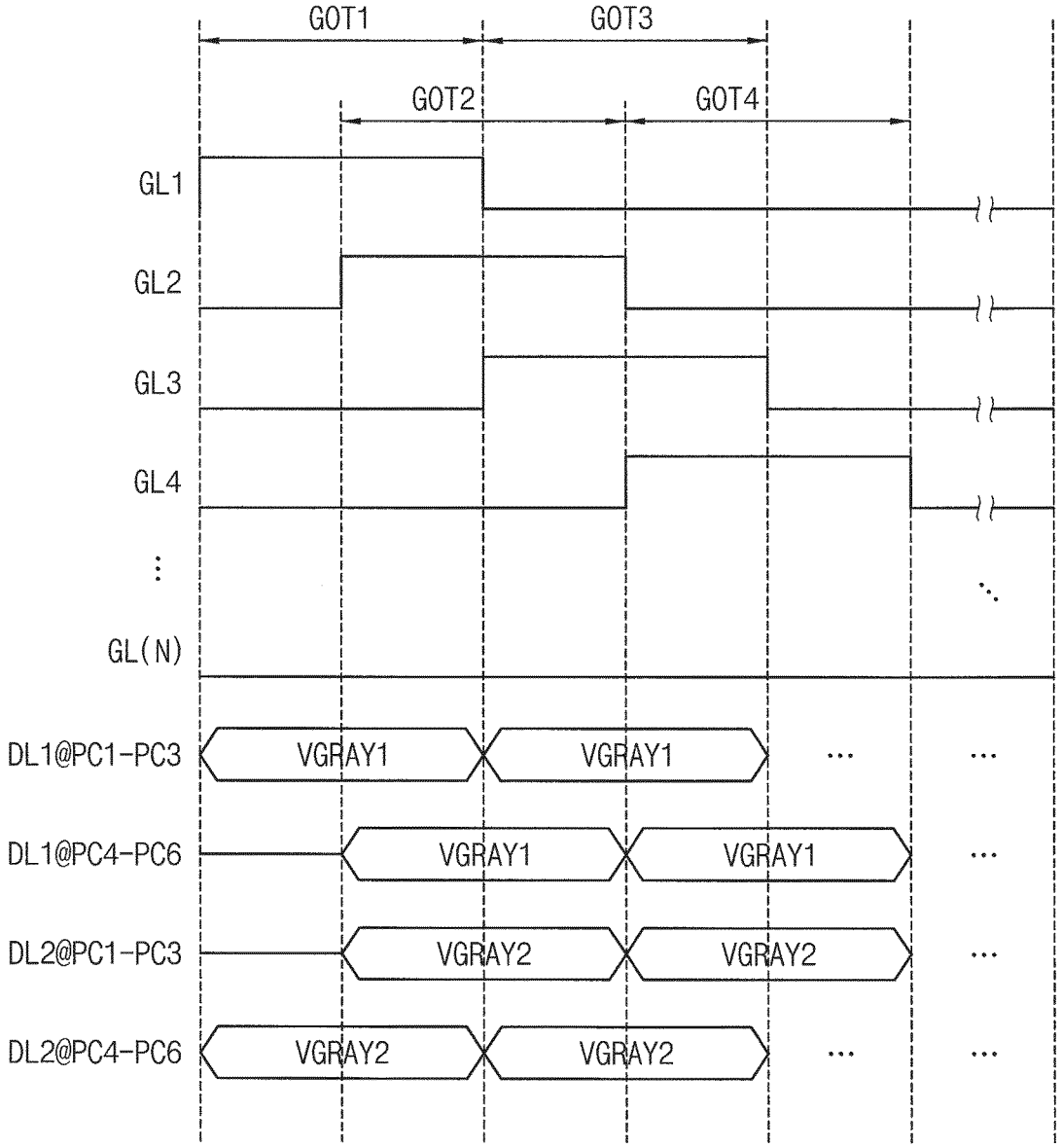
FIG. 12 is a timing diagram for describing another exemplary embodiment of an operation of a display device including a display panel of FIG. 9.
Figure 13A:
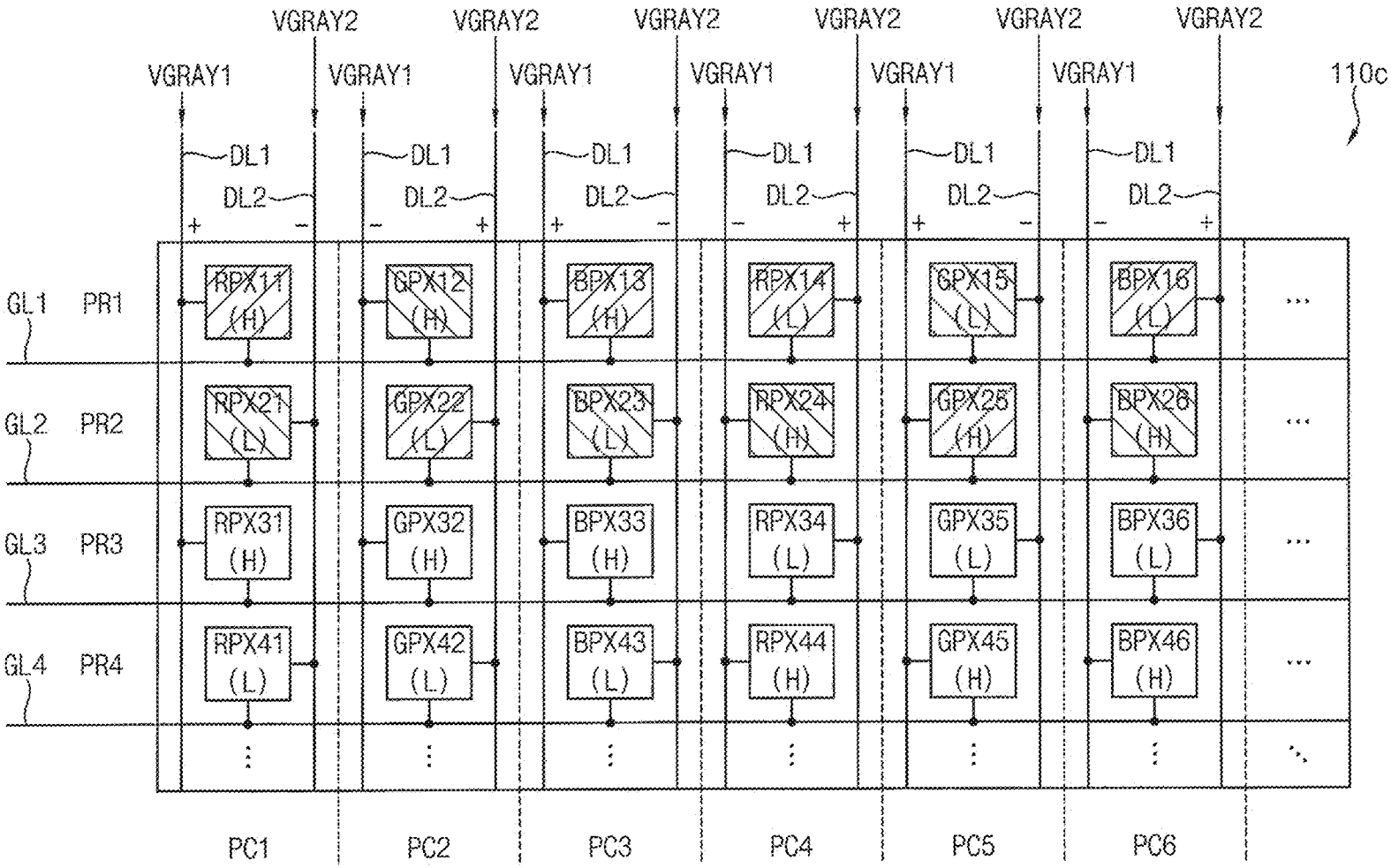
FIG. 13A is a diagram for describing an exemplary embodiment of an operation of a display panel of FIG. 9 during a time when a first gate on time and a second gate on time are overlapped.
Figure 13B:
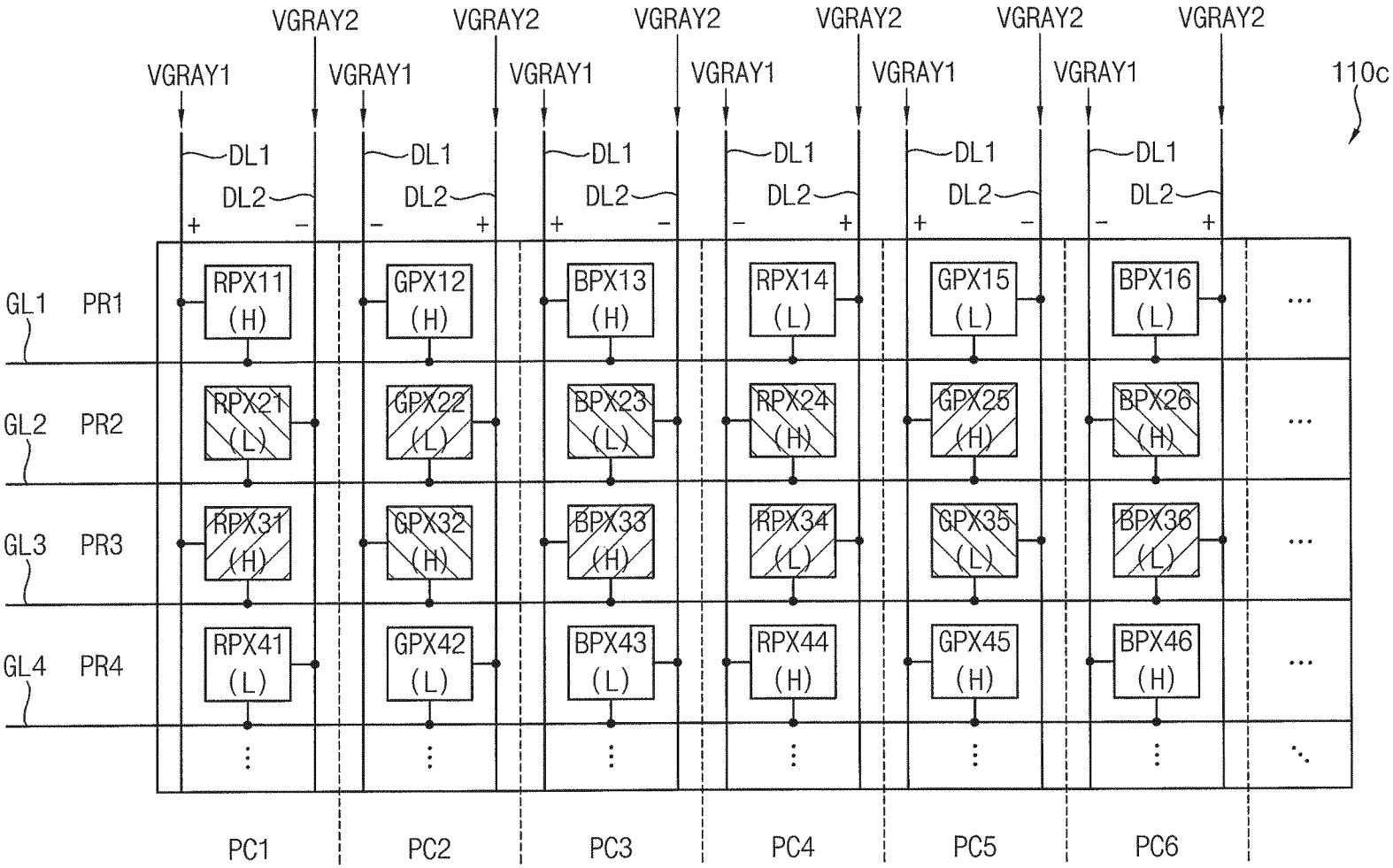
FIG. 13B is a diagram for describing an exemplary embodiment of an operation of a display panel of FIG. 9 during a time when a second gate on time and a third gate on time are overlapped.
Figure 13C:
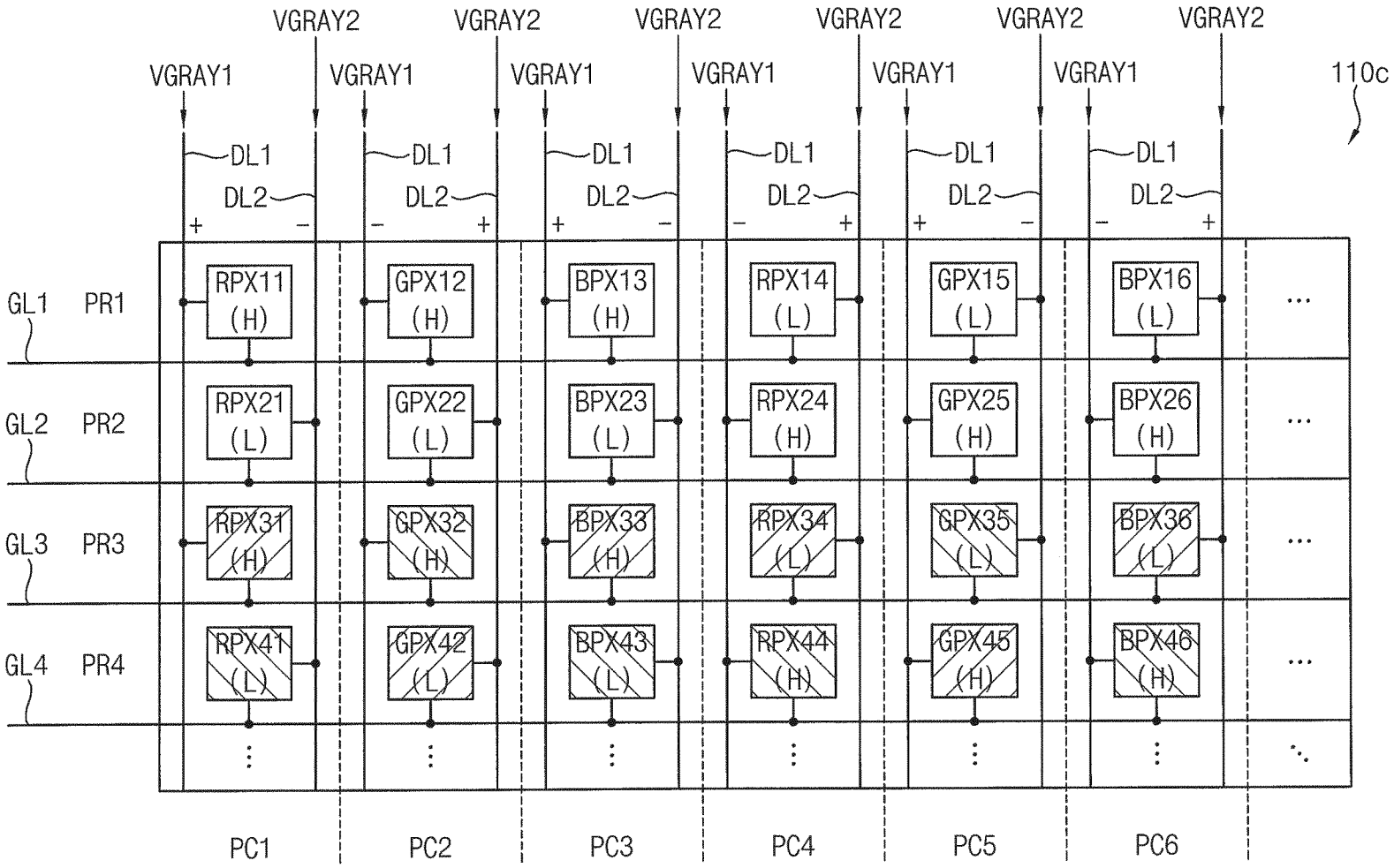
FIG. 13C is a diagram for describing an exemplary embodiment of an operation of a display panel of FIG. 9 during a time when a third gate on time and a fourth gate on time are overlapped.

FIG. 12 is a timing diagram for describing another exemplary embodiment of an operation of a display device including a display panel of FIG. 9, FIG. 13A is a diagram for describing an exemplary embodiment of an operation of a display panel of FIG. 9 during a time when a first gate on time and a second gate on time are overlapped, FIG. 13B is a diagram for describing an exemplary embodiment of an operation of a display panel of FIG. 9 during a time when a second gate on time and a third gate on time are overlapped, and FIG. 13C is a diagram for describing an exemplary embodiment of an operation of a display panel of FIG. 9 during a time when a third gate on time and a fourth gate on time are overlapped.

Referring to FIGS. 9 and 12, a display panel 110*c* may include a plurality of gate lines GL1, GL2, . . . , GL(N) of which the number corresponds to the number of a plurality of rows PR1 through PR4. In exemplary embodiments of the display panel 110*c*, as illustrated in FIG. 12, a gate signal may be sequentially applied to the plurality of gate lines GL1, GL2, . . . , GL(N).

In the example illustrated in FIG. 12, unlike the exemplary embodiment of FIG. 10 where respective gate on times GOT1, GOT2, GOT3 and GOT4 do not overlap each other, adjacent gate on times during which the gate signal is applied to adjacent gate lines may overlap each other. In an exemplary embodiment, a first gate on time GOT1 and a second gate on time GOT2 may overlap each other, the second gate on time GOT2 and a third gate on time GOT3 may overlap each other, and the third gate on time GOT3 and a fourth gate on time GOT4 may overlap each other, for example. During a time when the first gate on time GOT1 and the second gate on time GOT2 are overlapped, as illustrated in FIG. 13A, a positive/negative first gray voltage VGRAY1 or a positive/negative second gray voltage VGRAY2 may be applied to pixels RPX11, GPX12, BPX13, RPX14, GPX15, BPX16, RPX21, GPX22, BPX23, RPX24, GPX25 and BPX26 disposed at a first row PR1 and a second row PR2. Further, during a time when the second gate on time GOT2 and the third gate on time GOT3 are overlapped, as illustrated in FIG. 13B, the positive/negative first gray voltage VGRAY1 or the positive/negative second gray voltage VGRAY2 may be applied to pixels RPX21, GPX22, BPX23, RPX24, GPX25, BPX26, RPX31, GPX32, BPX33, RPX34, GPX35 and BPX36 disposed at the second row PR2 and a third row PR3. Further, during a time when the third gate on time GOT3 and the fourth gate on time GOT4 are overlapped, as illustrated in FIG. 13C, the positive/negative first gray voltage VGRAY1 or the positive/negative second gray voltage VGRAY2 may be applied to pixels RPX31, GPX32, BPX33, RPX34, GPX35, BPX36, RPX41, GPX42, BPX43, RPX44, GPX45 and BPX46 disposed at the third row PR3 and a fourth row PR4.

Accordingly, by the driving method illustrated in FIG. 12, the time when the gate signal is applied to each gate line GL1, GL2, . . . , GL(N), or each gate on time GOT1, GOT2, GOT3 and GOT4 may be increased. Accordingly, the driving method illustrated in FIG. 12 may be suitable for a large-sized display device that may have an insufficient gate signal application time.

Figure 14:
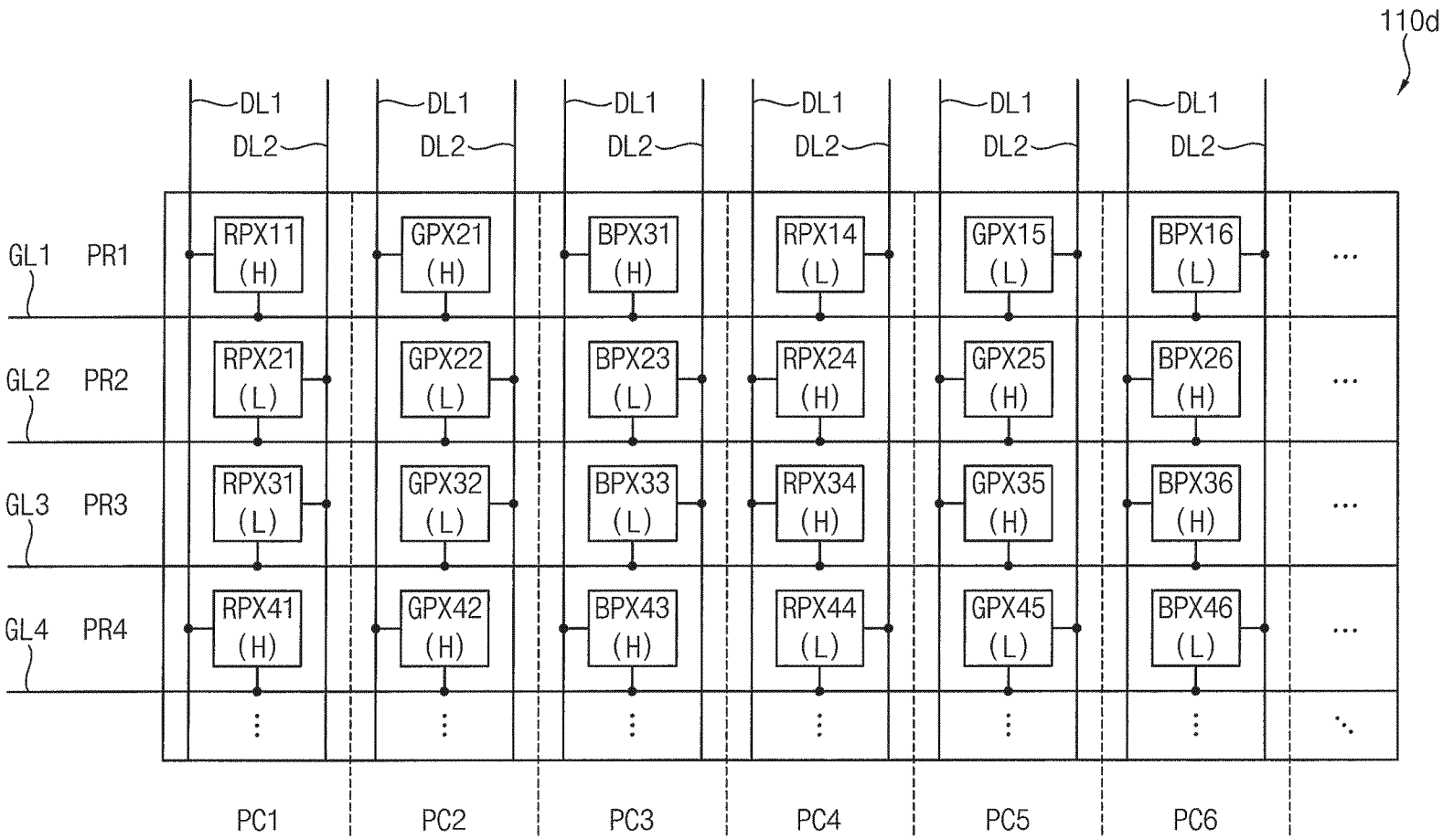
FIG. 14 is a diagram illustrating an exemplary embodiment of a display panel included in a display device.

FIG. 14 is a diagram illustrating an exemplary embodiment of a display panel included in a display device.

Referring to FIG. 14, a display panel 110*d* may include a plurality of pixels RPX11 through RPX44, GPX12 through GPX45 and BPX13 through BPX46 arranged at a plurality of rows PR1 through PR4 and a plurality of columns PC1 through PC6, a plurality of first data lines DL1 respectively disposed at the plurality of columns PC1 through PC6, a plurality of second data lines DL2 respectively disposed at the plurality of columns PC1 through PC6, and a plurality of gate lines GL1 through GL4 respectively disposed at the plurality of rows PR1 through PR4.

In the display panel 110*d*, the pixels RPX11 through RPX44, GPX12 through GPX45 and BPX13 through BPX46 at each column PC1 through PC6 may be connected alternately per two pixels to the first data line DL1 or to the second data line DL2. In an exemplary embodiment, with respect to the pixels RPX11 through RPX41 at a first column PC1, a first pixel RPX11 at a first row PR1 and a first column PC1 may be connected to the first data line DL1 and a first gate line GL1, a second pixel RPX21 at a second row PR2 and the first column PC1 may be connected to the second data line DL2 and a second gate line GL2, a third pixel RPX31 at a third row PR3 and the first column PC1 may be connected to the second data line DL2 and a third gate line GL3, and a fourth pixel RPX41 at a fourth row PR4 and the first column PC1 may be connected to the first data line DL1 and a fourth gate line GL4, for example. In exemplary embodiments, the display panel 110*d* may be driven by the driving method illustrated in FIG. 10 or the driving method illustrated in FIG. 12. Thus, the first pixel RPX11 and the fourth pixel RPX41 may display an image with luminance corresponding to a first gamma curve (e.g., a high gamma curve), and the second pixel RPX21 and the third pixel RPX31 may display an image with luminance corresponding to a second gamma curve (e.g., a low gamma curve). Accordingly, the side visibility may be improved without the image data modulation and the aperture ratio deterioration.

Although FIGS. 4 through 14 illustrate examples where the first gray voltages VGRAY1 corresponding to the first gamma curve (e.g., the high gamma curve) are applied to the first data lines DL1, and the second gray voltages VGRAY2 corresponding to the second gamma curve (e.g., the low gamma curve) are applied to the second data lines DL2, in some exemplary embodiments, the gamma characteristic of the first gray voltages VGRAY1 applied to the first data lines DL1 and the gamma characteristic of the second gray voltages VGRAY2 applied to the second data lines DL2 may be switched with a constant period or with a random period.

Figure 15:
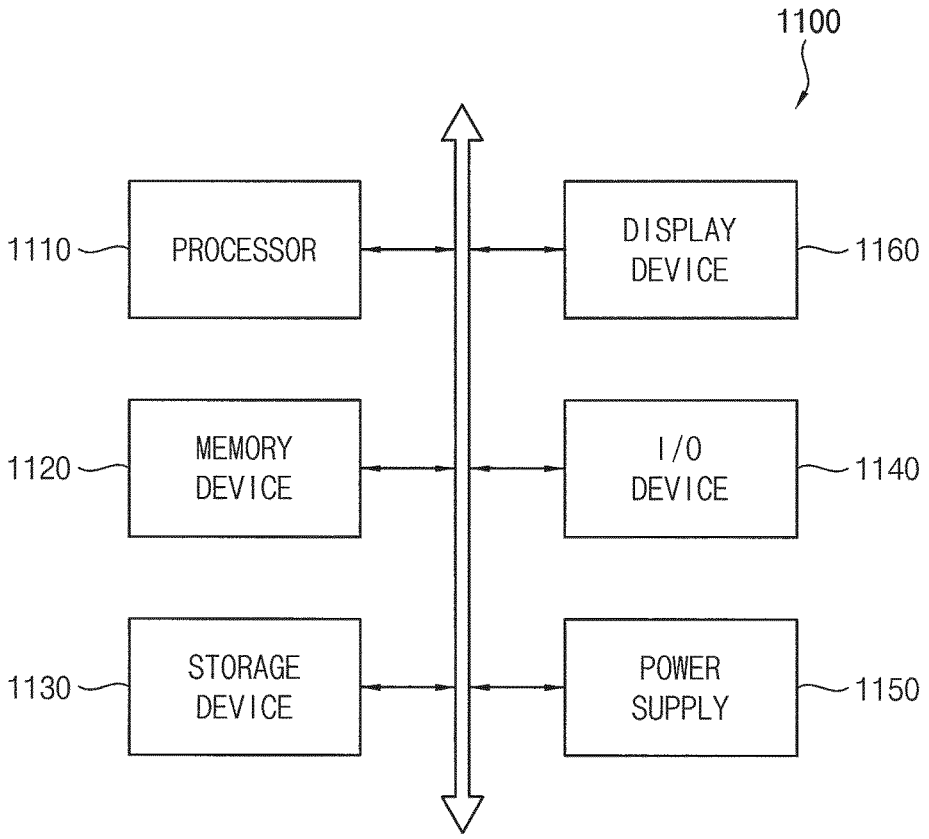
FIG. 15 is a block diagram illustrating an exemplary embodiment of an electronic device including a display device.

FIG. 15 is a block diagram illustrating an exemplary embodiment of an electronic device including a display device.

Referring to FIG. 15, an electronic device 1100 may include a processor 1110, a memory device 1120, a storage device 1130, an input/output ("I/O") device 1140, a power supply 1150, and a display device 1160. In an exemplary embodiment, the electronic device 1100 may further include a plurality of ports for communicating a video card, a sound card, a memory card, a universal serial bus ("USB") device, other electric devices, etc.

The processor 1110 may perform various computing functions or tasks. The processor 1110 may be an application processor ("AP"), a microprocessor, a central processing unit ("CPU"), etc. The processor 1110 may be coupled to other components via an address bus, a control bus, a data bus, etc. Further, in some exemplary embodiments, the processor 1110 may be further coupled to an extended bus such as a peripheral component interconnection ("PCI") bus.

The memory device 1120 may store data for operations of the electronic device 1100. In an exemplary embodiment, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory (DRAM) device, a static random access memory ("SRAM") device, a mobile dynamic random access memory ("mobile DRAM") device, etc.

The storage device 1130 may be a solid state drive ("SSD") device, a hard disk drive ("HDD") device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The display device 1160 may be coupled to other components through the buses or other communication links.

In the display device 1160, a display panel may include first and second data lines at each column, a first data driver connected to the first data lines may provide first gray voltages corresponding to a first gamma curve (e.g., a high gamma curve) based on a first gamma reference voltage and/or a first analog reference voltage, and a second data driver connected to the second data lines may provide second gray voltages corresponding to a second gamma curve (e.g., a low gamma curve) different from the first gamma curve based on a second gamma reference voltage and/or a second analog reference voltage. Accordingly, in exemplary embodiments of the display device 1160, although each pixel may not be divided into two sub-pixels, and image data are not modulated, the side visibility may be improved without the aperture ratio deterioration.

The exemplary embodiments of the invention may be applied to any display device 1160, and any electronic device 1100 including the display device 1160. In an exemplary embodiment, the invention may be applied to various devices such as a television ("TV"), a digital TV, a 3D TV, a smart phone, a wearable electronic device, a tablet computer, a mobile phone, a personal computer ("PC"), a home appliance, a laptop computer, a personal digital assistant ("PDA"), a portable multimedia player ("PMP"), a digital camera, a music player, a portable game console, a navigation device, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel including a plurality of pixels disposed at a plurality of rows and a plurality of columns, a plurality of first data lines respectively disposed at the plurality of columns, and a plurality of second data lines respectively disposed at the plurality of columns;

a first data driver connected to the plurality of first data lines; and a second data driver connected to the plurality of second data lines, wherein a first portion of the plurality of pixels is connected to the plurality of first data lines, and a second portion of the plurality of pixels is connected to the plurality of second data lines, and wherein the first data driver provides first gray voltages corresponding to a first gamma curve to the first portion of the plurality of pixels through the plurality of first data lines, and the second data driver provides second gray voltages corresponding to a second gamma curve different from the first gamma curve to the second portion of the plurality of pixels through the plurality of second data lines such that the first portion of the plurality of pixels and the second portion of the plurality of pixels display an image with different luminance for a same gray level.

2. The display device of claim 1, wherein the first gamma curve is a high gamma curve having a high gamma value greater than a reference gamma value, and the second gamma curve is a low gamma curve having a low gamma value less than the reference gamma value.

3. The display device of claim 1, further comprising:

a gamma reference voltage generator which generates a first gamma reference voltage corresponding to the first gamma curve and a second gamma reference voltage corresponding to the second gamma curve, provides the first gamma reference voltage to the first data driver, and provides the second gamma reference voltage to the second data driver, wherein the first data driver generates the first gray voltages corresponding to the first gamma curve based on the first gamma reference voltage, and the second data driver generates the second gray voltages corresponding to the second gamma curve based on the second gamma reference voltage.

4. The display device of claim 3, further comprising:

a power management circuit which generates a first analog reference voltage, and a second analog reference voltage different from the first analog reference voltage, wherein the gamma reference voltage generator generates the first gamma reference voltage by dividing the first analog reference voltage, and generates the second gamma reference voltage by dividing the second analog reference voltage.

5. The display device of claim 4, wherein the first data driver receives the first analog reference voltage and the first gamma reference voltage, and generates the first gray voltages corresponding to the first gamma curve by dividing the first analog reference voltage and the first gamma reference voltage, and wherein the second data driver receives the second analog reference voltage and the second gamma reference voltage, and generates the second gray voltages corresponding to the second gamma curve by dividing the second analog reference voltage and the second gamma reference voltage.

6. The display device of claim 1, wherein the first data driver is disposed on a first film connected to the plurality of first data lines of the display panel, and wherein the second data driver is disposed on a second film above the first film, and the second film is connected to the plurality of second data lines of the display panel.

7. The display device of claim 1, wherein the display panel further includes a plurality of gate lines, and a number of the plurality of gate lines is half of a number of the plurality of rows, and wherein the plurality of pixels at two rows of the plurality of rows is connected to one of the plurality of gate lines.

8. The display device of claim 7, wherein the plurality of pixels includes:

a first pixel disposed at a first row of the plurality of rows and a first column of the plurality of columns, connected to one of the plurality of first data lines disposed at the first column, and connected to a first gate line of the plurality of gate lines;

a second pixel disposed at a second row of the plurality of rows and the first column, connected to one of the plurality of second data lines disposed at the first column, and connected to the first gate line;

a third pixel disposed at a third row of the plurality of rows and the first column, connected to the one of the plurality of first data lines disposed at the first column, and connected to a second gate line of the plurality of gate lines; and a fourth pixel disposed at a fourth row of the plurality of rows and the first column, connected to the one of the plurality of second data lines disposed at the first column, and connected to the second gate line, and wherein the first pixel and the third pixel display the image with luminance corresponding to the first gamma curve, and the second pixel and the fourth pixel display the image with luminance corresponding to the second gamma curve.

9. The display device of claim 7, wherein the plurality of pixels includes:

a first pixel disposed at a first row of the plurality of rows and a first column of the plurality of columns, connected to one of the plurality of first data lines disposed at the first column, and connected to a first gate line of the plurality of gate lines;

a second pixel disposed at a second row of the plurality of rows and the first column, connected to one of the plurality of second data lines disposed at the first column, and connected to the first gate line;

a third pixel disposed at a third row of the plurality of rows and the first column, connected to the one of the plurality of second data lines disposed at the first column, and connected to a second gate line of the plurality of gate lines; and a fourth pixel disposed at a fourth row of the plurality of rows and the first column, connected to the one of the plurality of first data lines disposed at the first column, and connected to the second gate line, and wherein the first pixel and the fourth pixel display the image with luminance corresponding to the first gamma curve, and the second pixel and the third pixel display the image with luminance corresponding to the second gamma curve.

10. The display device of claim 1, wherein the display panel further includes a plurality of gate lines respectively disposed at the plurality of rows, and wherein the plurality of pixels at each of the plurality of rows is connected to one of the plurality of gate lines.

11. The display device of claim 10, wherein the plurality of pixels includes:

a first pixel disposed at a first row of the plurality of rows and a first column of the plurality of columns, connected to one of the plurality of first data lines disposed at the first column, and connected to a first gate line of the plurality of gate lines;

a second pixel disposed at a second row of the plurality of rows and the first column, connected to one of the plurality of second data lines disposed at the first column, and connected to a second gate line of the plurality of gate lines;

a third pixel disposed at a third row of the plurality of rows and the first column, connected to the one of the plurality of first data lines disposed at the first column, and connected to a third gate line of the plurality of gate lines; and a fourth pixel disposed at a fourth row of the plurality of rows and the first column, connected to the one of the plurality of second data lines disposed at the first column, and connected to a fourth gate line of the plurality of gate lines, and wherein the first pixel and the third pixel display the image with luminance corresponding to the first gamma curve, and the second pixel and the fourth pixel display the image with luminance corresponding to the second gamma curve.

12. The display device of claim 10, wherein the plurality of pixels includes:

a first pixel disposed at a first row of the plurality of rows and a first column of the plurality of columns, connected to one of the plurality of first data lines disposed at the first column, and connected to a first gate line of the plurality of gate lines;

a second pixel disposed at a second row of the plurality of rows and the first column, connected to one of the plurality of second data lines disposed at the first column, and connected to a second gate line of the plurality of gate lines;

a third pixel disposed at a third row of the plurality of rows and the first column, connected to the one of the plurality of second data lines disposed at the first column, and connected to a third gate line of the plurality of gate lines; and a fourth pixel disposed at a fourth row of the plurality of rows and the first column, connected to the one of the plurality of first data lines disposed at the first column, and connected to a fourth gate line of the plurality of gate lines, and wherein the first pixel and the fourth pixel display the image with luminance corresponding to the first gamma curve, and the second pixel and the third pixel display the image with luminance corresponding to the second gamma curve.

13. The display device of claim 1, wherein the plurality of pixels disposed at a first column and a fourth column of the plurality of columns is red pixels, wherein the plurality of pixels disposed at a second column adjacent to the first column and a fifth column adjacent to the fourth column of the plurality of columns is green pixels, and wherein the plurality of pixels disposed at a third column adjacent to the second column and a sixth column adjacent to the fifth column of the plurality of columns is blue pixels.

14. The display device of claim 13, wherein the red, green and blue pixels disposed at a first row of the plurality of rows and respectively disposed at the first, second and third columns are connected to the plurality of first data lines, and wherein the red, green and blue pixels disposed at the first row and respectively disposed at the fourth, fifth and sixth columns are connected to the plurality of second data lines.

15. The display device of claim 14, wherein the red, green and blue pixels disposed at the first row and respectively disposed at the first, second and third columns display the image with luminance corresponding to the first gamma curve, and wherein the red, green and blue pixels disposed at the first row and respectively disposed at the fourth, fifth and sixth columns display the image with luminance corresponding to the second gamma curve.

16. A display device comprising:

a display panel including a plurality of pixels disposed at a plurality of rows and a plurality of columns, a plurality of first data lines respectively disposed at the plurality of columns, a plurality of second data lines respectively disposed at the plurality of columns, and a plurality of gate lines, a number of the plurality of gate lines being half of a number of the plurality of rows;

a first data driver connected to the plurality of first data lines;

a second data driver connected to the plurality of second data lines; and a gate driver connected to the plurality of gate lines, wherein the plurality of pixels include:

a first pixel disposed at a first row of the plurality of rows and a first column of the plurality of columns, connected to one of the plurality of first data lines disposed at the first column, and connected to a first gate line of the plurality of gate lines; and a second pixel disposed at a second row of the plurality of rows and the first column, connected to one of the plurality of second data lines disposed at the first column, and connected to the first gate line, and wherein, while the gate driver applies a gate signal to the first gate line, the first data driver provides a first gray voltage corresponding to a first gamma curve to the first pixel through the one of the plurality of first data lines disposed at the first column, and the second data driver provides a second gray voltage corresponding to a second gamma curve different from the first gamma curve to the second pixel through the one of the plurality of second data lines disposed at the first column such that the first pixel and the second pixel display an image with different luminance for a same gray level.

17. The display device of claim 16, wherein the first gamma curve is a high gamma curve having a high gamma value greater than a reference gamma value, and the second gamma curve is a low gamma curve having a low gamma value less than the reference gamma value.

18. The display device of claim 16, wherein the plurality of pixels further includes:

a third pixel disposed at a third row of the plurality of rows and the first column, connected to the one of the plurality of first data lines disposed at the first column, and connected to a second gate line of the plurality of gate lines; and a fourth pixel disposed at a fourth row of the plurality of rows and the first column, connected to the one of the plurality of second data lines disposed at the first column, and connected to the second gate line, and wherein the first pixel and the third pixel display the image with luminance corresponding to the first gamma curve, and the second pixel and the fourth pixel display the image with luminance corresponding to the second gamma curve.

19. The display device of claim 16, wherein the plurality of pixels further includes:

a third pixel disposed at a third row of the plurality of rows and the first column, connected to the one of the plurality of second data lines disposed at the first column, and connected to a second gate line of the plurality of gate lines; and a fourth pixel disposed at a fourth row of the plurality of rows and the first column, connected to the one of the plurality of first data lines disposed at the first column, and connected to the second gate line, and wherein the first pixel and the fourth pixel display the image with luminance corresponding to the first gamma curve, and the second pixel and the third pixel display the image with luminance corresponding to the second gamma curve.

* * * * *